US007144099B2

(12) United States Patent
Cabal et al.

(10) Patent No.: US 7,144,099 B2
(45) **Date of Patent: *Dec. 5, 2006**

(54) LIQUID DROP EMITTER WITH SPLIT THERMO-MECHANICAL ACTUATOR

(75) Inventors: Antonio Cabal, Webster, NY (US); John A. Lebens, Rush, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/294,252

(22) Filed: Dec. 5, 2005

(65) Prior Publication Data

US 2006/0082615 A1 Apr. 20, 2006

Related U.S. Application Data

(63) Continuation of application No. 10/608,498, filed on Jun. 27, 2003, now Pat. No. 7,025,443.

(51) Int. Cl.
*B41J 2/04* (2006.01)

(52) U.S. Cl. ..... 347/54; 347/56; 347/65

(58) Field of Classification Search ..... 347/20, 347/44, 47, 54, 56, 61–65, 67, 57–59; 60/527–529
See application file for complete search history.

(56) References Cited

U.S. PATENT DOCUMENTS

| | | | | |
|---|---|---|---|---|
| 3,747,120 | A | 7/1973 | Stemme | 347/70 |
| 3,946,398 | A | 3/1976 | Kyser et al. | 347/70 |
| 4,296,421 | A | 10/1981 | Hara et al. | 347/56 |
| 5,599,695 | A | 2/1997 | Pease et al. | 435/91.1 |
| 5,771,882 | A | 6/1998 | Psaros et al. | 128/203.12 |
| 5,902,648 | A | 5/1999 | Naka et al. | 427/558 |
| 6,067,797 | A | 5/2000 | Silverbrook | 60/528 |
| 6,087,638 | A | 7/2000 | Silverbrook | 347/84 |
| 6,123,419 | A | 9/2000 | Cleland | |
| 6,180,427 | B1 | 1/2001 | Silverbrook | 347/47 |
| 6,239,821 | B1 | 5/2001 | Silverbrook | 347/54 |
| 6,254,793 | B1 | 7/2001 | Silverbrook | 216/27 |
| 6,274,056 | B1 | 8/2001 | Silverbrook | 347/54 |
| 6,416,168 | B1 | 7/2002 | Silverbrook | 347/54 |
| 6,464,341 | B1 | 10/2002 | Furlani et al. | 347/54 |

(Continued)

FOREIGN PATENT DOCUMENTS

| | | |
|---|---|---|
| JP | 20330543 | 1/1990 |

*Primary Examiner*—Juanita D. Stephens
(74) *Attorney, Agent, or Firm*—William R. Zimmerlz

(57) ABSTRACT

An apparatus for a liquid drop emitter, especially for use in an ink jet printhead, is disclosed. A chamber filled with a liquid, a nozzle and a thermo-mechanical actuator, extending into the chamber from at least one wall of the chamber is disclosed. A movable element of the thermo-mechanical actuator is configured with a bending portion which bends when heated, the bending portion having at least one actuator opening for passage of the liquid. Apparatus is adapted to apply heat pulses to the bending portion resulting in rapid deflection of the movable element, ejection of a liquid drop, and passage of liquid through the at least one actuator opening. A movable element configured as a cantilever or as a beam extending from anchor walls of the chamber is disclosed. The thermo-mechanical actuator may be formed as a laminate structure including a layer constructed of a deflector material having a high coefficient of thermal expansion and that is electrically resistive, for example, titanium aluminide. Apparatus adapted to apply heat pulses comprising a resistive heater formed in the deflector material in the bending portion is also disclosed.

19 Claims, 22 Drawing Sheets

U.S. PATENT DOCUMENTS 6,561,627 B1 5/2003 Jarrold et al. ..... 347/54
6,588,884 B1 * 7/2003 Furlani et al. ..... 347/54
7,025,443 B1 * 4/2006 Cabal et al. ..... 347/54
2001/0038403 A1 11/2001 Silverbrook ..... 347/54
2004/0155917 A1 * 8/2004 Trauernicht et al. ..... 347/19

* cited by examiner

LIQUID DROP EMITTER WITH SPLIT THERMO-MECHANICAL ACTUATOR

CROSS REFERENCE TO RELATED APPLICATIONS

This is a Continuation application of U.S. Ser. No. 10/608,498 filed Jun. 27, 2003, now issued as U.S. Pat. No. 7,025,443.

FIELD OF THE INVENTION

The present invention relates generally to micro-electro-mechanical devices and, more particularly, to thermally actuated liquid drop emitters such as the type used for ink jet printing.

BACKGROUND OF THE INVENTION

Micro-electro mechanical systems (MEMS) are a relatively recent development. Such MEMS are being used as alternatives to conventional electro-mechanical devices as actuators, valves, and positioners. Micro-electromechanical devices are potentially low cost, due to use of microelectronic fabrication techniques. Novel applications are also being discovered due to the small size scale of MEMS devices.

Many potential applications of MEMS technology utilize thermal actuation to provide the motion needed in such devices. For example, many actuators, valves and positioners use thermal actuators for movement. In some applications the movement required is pulsed. For example, rapid displacement from a first position to a second, followed by restoration of the actuator to the first position, might be used to generate pressure pulses in a fluid or to advance a mechanism one unit of distance or rotation per actuation pulse. Drop-on-demand liquid drop emitters use discrete pressure pulses to eject discrete amounts of liquid from a nozzle.

Drop-on-demand (DOD) liquid emission devices have been known as ink printing devices in ink jet printing systems for many years. Early devices were based on piezoelectric actuators such as are disclosed by Kyser et al., in U.S. Pat. No. 3,946,398 and Stemme in U.S. Pat. No. 3,747,120. A currently popular form of ink jet printing, thermal ink jet (or "bubble jet"), uses electroresistive heaters to generate vapor bubbles which cause drop emission, as is discussed by Hara et al., in U.S. Pat. No. 4,296,421.

Electroresistive heater actuators have manufacturing cost advantages over piezoelectric actuators because they can be fabricated using well developed microelectronic processes. On the other hand, the thermal ink jet drop ejection mechanism requires the ink to have a vaporizable component, and locally raises ink temperatures well above the boiling point of this component. This temperature exposure places severe limits on the formulation of inks and other liquids that may be reliably emitted by thermal ink jet devices. Piezoelectrically actuated devices do not impose such severe limitations on the liquids that can be jetted because the liquid is mechanically pressurized.

The availability, cost, and technical performance improvements that have been realized by ink jet device suppliers have also engendered interest in the devices for other applications requiring micro-metering of liquids. These new applications include dispensing specialized chemicals for micro-analytic chemistry as disclosed by Pease et al., in U.S. Pat. No. 5,599,695; dispensing coating materials for electronic device manufacturing as disclosed by Naka et al., in U.S. Pat. No. 5,902,648; and for dispensing microdrops for medical inhalation therapy as disclosed by Psaros et al., in U.S. Pat. No. 5,771,882. Devices and methods capable of emitting, on demand, micron-sized drops of a broad range of liquids are needed for highest quality image printing, but also for emerging applications where liquid dispensing requires mono-dispersion of ultra small drops, accurate placement and timing, and minute increments.

A low cost approach to micro drop emission is needed which can be used with a broad range of liquid formulations. Apparatus and methods are needed which combines the advantages of microelectronic fabrication used for thermal ink jet with the liquid composition latitude available to piezo-electro-mechanical devices.

A DOD ink jet device which uses a thermo-mechanical actuator was disclosed by T. Kitahara in JP 2,030,543, filed Jul. 21, 1988. The actuator is configured as a bi-layer cantilever moveable within an ink jet chamber. The beam is heated by a resistor causing it to bend due to a mismatch in thermal expansion of the layers. The free end of the beam moves to pressurize the ink at the nozzle causing drop emission. Recently disclosures of a similar thermo-mechanical DOD ink jet configuration have been made by K. Silverbrook in U.S. Pat. Nos. 6,067,797; 6,087,638; 6,239,821 and 6,243,113. Methods of manufacturing thermo-mechanical ink jet devices using microelectronic processes have been disclosed by K. Silverbrook in U.S. Pat. Nos. 6,180,427; 6,254,793 and 6,274,056.

Thermo-mechanically actuated drop emitters employing a moving cantilevered element are promising as low cost devices which can be mass produced using microelectronic materials and equipment and which allow operation with liquids that would be unreliable in a thermal ink jet device. However, the design and operation of cantilever style thermal actuators and drop emitters requires careful attention to the input energy needed to eject a drop of a given volume, as well as to the rapid dissipation of this energy, in order to maximize the sustainable repetition frequency of the device. The required input energy may be reduced by configuring the cantilevered element so as to minimize drag effects on the backside of the cantilevered element during its motion.

Locations of potentially excessive heat, "hot spots", within the cantilevered element, especially any that may be adjacent to the working liquid, are detrimental in that reliability limitations may be imposed on the peak temperatures that may be employed, limiting overall energy efficiency. When the cantilevered element is deflected by supplying electrical energy pulses to an on-board resistive heater, the pulse current is, most conveniently, directed on and off the moveable (deflectable) structure where the cantilevered element is anchored to a base element. The current reverses direction at some locations on the cantilevered element that may become places of higher current density and power density, resulting in hot spots.

An alternate configuration of the thermal actuator, an elongated beam anchored within the liquid chamber at two opposing walls, is a promising approach when high forces are required to eject liquids having high viscosities.

Design concepts which reduce the back pressure drag on the movable portions of beam actuators are also valuable in reducing the required energy input or in otherwise increasing the efficiency of drop ejection.

The space required to configure a thermal actuator capable of ejecting a given drop volume is an important determiner of the linear density that can be achieved in forming an array of drop emitters. Higher spatial densities of drop emitters in an array may, in turn, lead to lower costs per emitter and higher emitter numbers in an array a particular size. Higher emitter-number arrays may provide higher net fluid pumping capability and higher resolution and throughput when used for ink jet printing Designs for thermally actuated drop emitters are needed that can be operated with decreased input energy, improved heat dissipation, and reduced spatial extent, while avoiding locations of extreme temperature or generating vapor bubbles.

SUMMARY OF THE INVENTION

It is therefore an object of the present invention to provide a thermally actuated drop emitter using a moving element that can be operated at lower input energy per drop by reducing drag forces on the moving element.

It is also an object of the present invention to provide a thermally actuated drop emitter using a moving cantilevered element having a configuration that improves heat dissipation thereby allowing an improved frequency of drop emission.

It is also an object of the present invention to provide a thermally actuated drop emitter using a moving cantilevered element that does not have locations which reach excessive temperatures, and can be operated at lower input energy per drop.

In addition, it is an object of the present invention to provide a liquid drop emitter configuration requiring reduced overall space.

The foregoing and numerous other features, objects and advantages of the present invention will become readily apparent upon a review of the detailed description, claims and drawings set forth herein. These features, objects and advantages are accomplished by constructing a liquid drop emitter comprising a chamber, formed in a substrate, filled with a liquid and having a nozzle for emitting drops of the liquid. A thermo-mechanical actuator, extending into the chamber from at least one wall of the chamber, and having a movable element resides in a first position proximate to the nozzle. The movable element is configured with a bending portion which bends when heated, the bending portion having at least one actuator opening for passage of the liquid. Apparatus is adapted to apply heat pulses to the bending portion resulting in rapid deflection of the movable element to a second position, ejection of a liquid drop, and passage of liquid through the at least one actuator opening. The movable element may be configured as a cantilever extending from an anchor wall of the chamber. The moveable element may also be configured as a beam anchored at opposite first and second anchor walls. The thermo-mechanical actuator may be formed as a laminate structure including a deflector layer constructed of a deflector material having a high coefficient of thermal expansion and that is electrically resistive, for example, titanium aluminide. Apparatus adapted to apply heat pulses may comprise a resistive heater formed in the deflector material in the bending portion.

Liquid drop emitters of the present inventions are particularly useful in ink jet printheads for ink jet printing.

DETAILED DESCRIPTION OF THE INVENTION

The invention has been described in detail with particular reference to certain preferred embodiments thereof, but it will be understood that variations and modifications can be effected within the spirit and scope of the invention.

As described in detail herein below, the present invention provides apparatus for a drop-on-demand liquid emission device. The most familiar of such devices are used as printheads in ink jet printing systems. Many other applications are emerging which make use of devices similar to ink jet printheads, however which emit liquids other than inks that need to be finely metered and deposited with high spatial precision. The terms ink jet and liquid drop emitter will be used herein interchangeably. The inventions described below provide drop emitters based on thermo-mechanical actuators which are configured so as minimize the spatial width of individual units to thereby facilitate close packing in an array of jets. The configurations of the present inventions are also designed to reduce fluid back-pressure effects and to promote heat dissipation, thereby facilitating operation of emitters at higher drop repetition frequencies.

Figure 1:
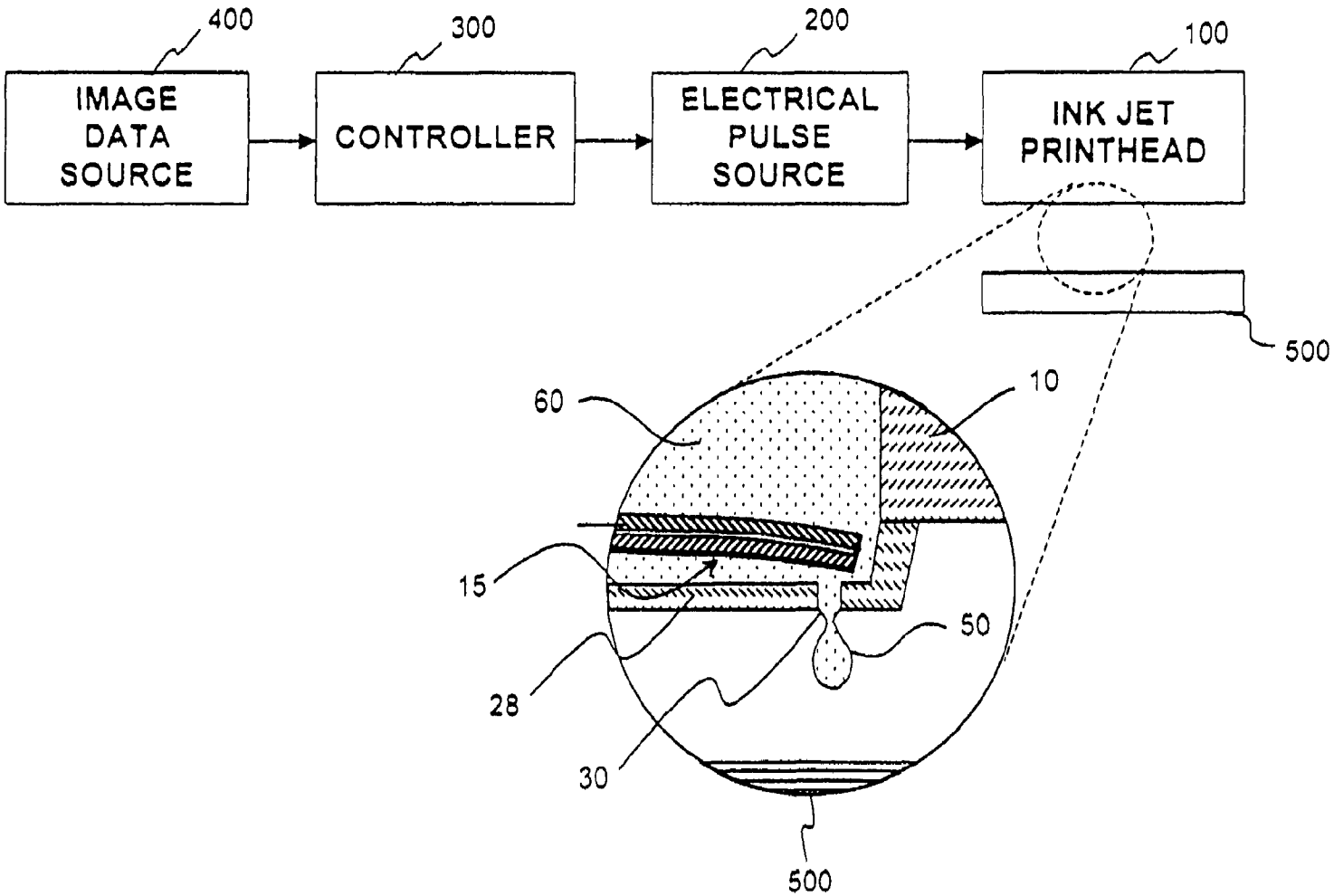
FIG. 1 is a schematic illustration of an ink jet system according to the present invention.

Turning first to FIG. 1, there is shown a schematic representation of an ink jet printing system which may use an apparatus and be operated according to the present invention. The system includes an image data source 400 which provides signals that are received by controller 300 as commands to print drops. Controller 300 outputs signals to a source of electrical pulses 200. Pulse source 200, in turn, generates an electrical voltage signal composed of electrical energy pulses which are applied to electrically resistive means associated with each thermo-mechanical actuator 15 within ink jet printhead 100. The electrical energy pulses cause a thermo-mechanical actuator 15 (herein after "thermal actuator") to rapidly bend, pressurizing ink 60 located at nozzle 30, and emitting an ink drop 50 which lands on receiver 500.

Figure 2A:
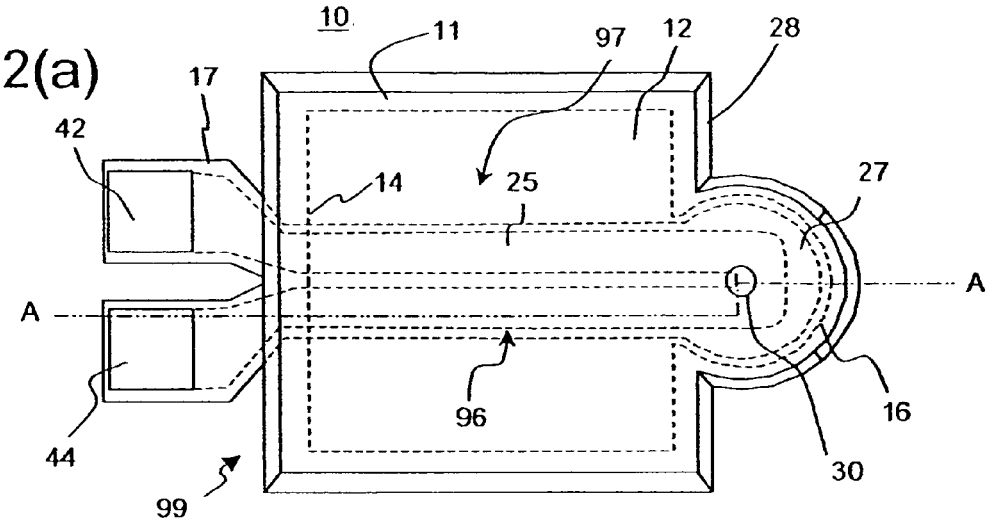
FIGS. 2(*a*)–2(*b*) are enlarged plan views of an individual ink jet unit which does not have an important element of the present inventions.
Figure 2B:
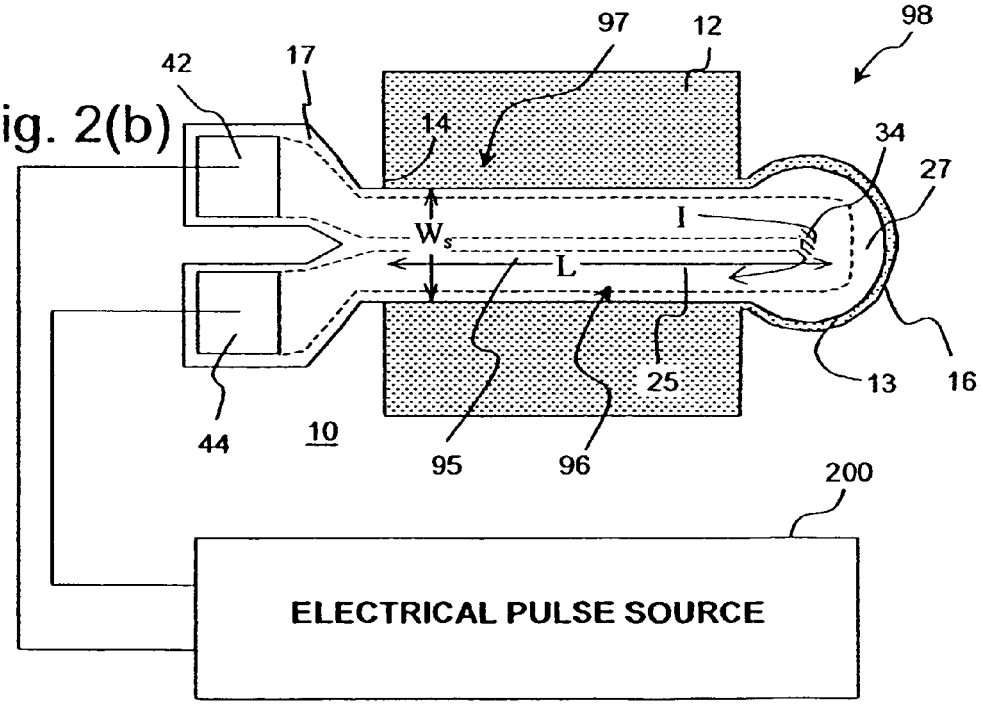

FIG. 2(*a*) illustrates a plan view of a single drop emitter unit 99 and a second plan view, FIG. 2(*b*), with the liquid chamber structure 28, including nozzle 30, removed. The single drop emitter design 99 is not representative of the present inventions. It is shown to explain the improvements offered by the present inventions below. The thermal actuator 97, shown in phantom in FIG. 2*a* can be seen with solid lines in FIG. 2(*b*). The cantilevered element 96 of thermal actuator 97 extends from wall edge 14 of lower liquid chamber 12 that is formed in substrate 10. Cantilevered element anchor portion 17 is bonded to substrate 10 and anchors the cantilever.

The cantilevered element 97 of the actuator has the shape of a paddle, an extended flat shaft 95 ending with a disc 27 of larger diameter than the shaft width. The paddle shape aligns the nozzle 30 with the center of the cantilevered element disc-shaped free end portion 27. The area of the free end portion 27 is sized to cause sufficient fluid volume displacement adjacent the nozzle so that a liquid drop of the desired size is emitted. The fluid chamber 12 has a curved wall portion at 16 which conforms to the curvature of the free end portion 27, spaced away to provide clearance for the actuator movement. The fluid chamber 12 is significantly wider than the width $W_S$ of shaft 95 of cantilevered element 96 in order to provide sufficient fluid refill cross sectional area from lower chamber 12 to upper chamber 11.

FIG. 2(*b*) illustrates schematically the attachment of electrical pulse source 200 to the resistive heater 25 at interconnect terminals 42 and 44. Voltage differences are applied to voltage terminals 42 and 44 to cause resistance heating via u-shaped resistor 25. This is generally indicated by an arrow showing a current I. In the plan views of FIGS. 2(*a*) and 2(*b*), the actuator free end portion 27 moves toward the viewer when pulsed and drops are emitted toward the viewer from the nozzle 30 in structure 28. This geometry of actuation and drop emission is called a "roof shooter" in many ink jet disclosures.

In practice the unshaped resistor 25 design illustrated in FIG. 2(*b*) may cause the development of a "hot spot" 34 caused by electrical current crowding as the current must change direction sharply in this area. The presence of potential hot spots limits the amount of current that may be applied to heat the resistor 25, overall, if failure of some layer materials due to excessive temperature excursion is to be avoided. This consideration, in turn, causes the necessity of building a wider or longer thermal actuator operated at lower average temperature excursions, or to operating at reduced drop repetition frequencies, or both.

Making the cantilevered element 96 wider or longer makes each individual drop emitter larger, thereby reducing the spatial packing density that may be achieved in an array of drop emitters. The cost of printhead fabrication is sensitive to the spatial packing density of individual emitters since device arrays are fabricated on a substrate using expensive microelectronic processes. The smaller the liquid drop emitter configuration, the more that are fabricated simultaneously on the substrate (i.e. a silicon wafer), the lower is the cost/emitter.

In order to eject a liquid drop, a moving element of the thermal actuator must accelerate sufficient liquid volume in the vicinity of the nozzle. When operated, fluid adjacent the nozzle 30 is accelerated by free end portion 27. However, the extended rectangular shaft 95 of the cantilevered element 96 also moves and displaces liquid. As the cantilevered element deflects about anchor location 14 it pushes liquid on one side and drags fluid on the opposite side. The drag of fluid beneath free end 27 cannot be avoided since this displacement is required to achieve drop emission. However, the push and drag of fluid along the shaft 95 of the thermal actuator represents an energy inefficiency which might be reduced to improve the net amount of energy used per drop emission.

Simply narrowing the cantilever element shaft will reduce the liquid push and drag energy losses. The paddle shapes illustrated in FIGS. 2(*a*) and 2(*b*) show some narrowing of the shaft 95 relative to the free end disc 27. In general, the deflection of the free end of a cantilevered thermal actuator is proportional to the length squared, $L^2$. The strength of the deflection force is proportional to the width of the heat-actuated portion of shaft 95, $W_s$. The shaft 95 cannot be narrowed without compromising the amount of force produced if the heated area is also narrowed. Further, a narrowed shaft is prone to twist. It may be difficult to fabricate the narrowest shaft permitted by force requirements without causing some material or geometrical asymmetries perpendicular to the elongation direction that result in twisted actuators, post-fabrication. Twisted actuators will not move as intended in the upper and lower liquid chambers causing poor drop emission.

The inventors of the present inventions have realized that the thermal actuator inefficiencies and fabrication difficulties described above with respect to paddle-shaped cantilevered element 96 may be overcome by using a novel actuator design. The novel thermal actuators of the present inventions are a result of combining at least the following several considerations. The movable length of the actuator is selected, in part, to achieve a target amount of deflection of a nozzle fluid moving portion of the actuator that is in close proximity to the nozzle. This nozzle fluid moving portion of the actuator may be the tip end of a cantilevered element, a center portion of a beam element, or the like.

The width, $W_{fm}$, of the nozzle fluid moving portion of the thermal actuator is selected, in part, so that, when combined with the target amount of deflection and other factors, including fluid resistances and compliances within the liquid chamber, a drop of sufficient volume is produced.

The width, $W_a$, of the heated portion of the actuator is selected, in part, to achieve sufficient force to eject a droplet of the target volume and target velocity, given the working fluid properties that are necessary for the drop emitter application. Energy efficiency is optimized, in part, by selection of the narrowest heated portion possible. It is further advantageous to narrow the moving element of a thermal actuator, in areas other than the fluid moving portion adjacent the nozzle, in order to reduce the energy spent in pushing and dragging fluid, unnecessarily.

Following, in part, the above considerations, the inventors of the present inventions have found that the heated actuator portion width may be made substantially narrower than the fluid moving portion, $W_a<W_{fm}$, for many important applications of fluid drop emitters. The inventors have further realized that an effective "narrowing" of the heated portions and of the moving element of a thermal actuator may be accomplished by the use of through openings which eliminate, or render stationary, areas of the moving element.

Figure 3A:
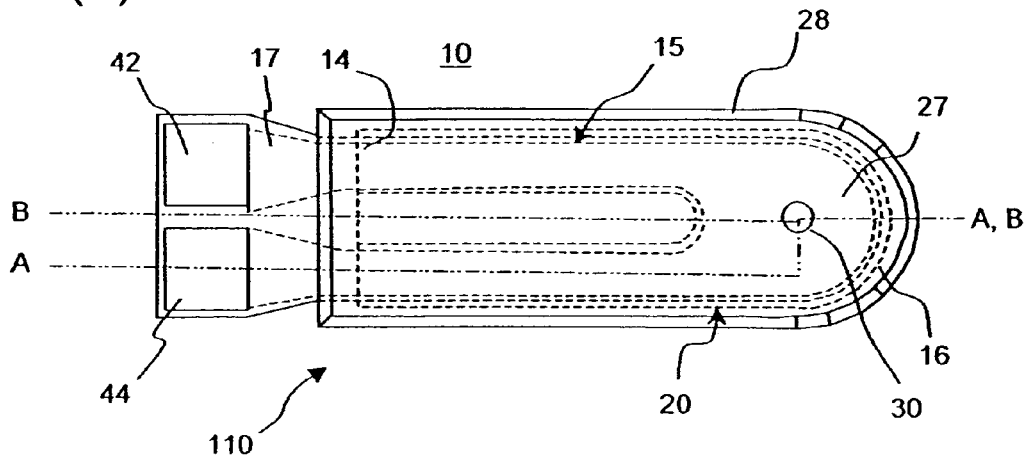
FIGS. 3(*a*)–3(*b*) are enlarged plan views of an individual ink jet or liquid drop emitter unit according to the present invention.
Figure 3B:
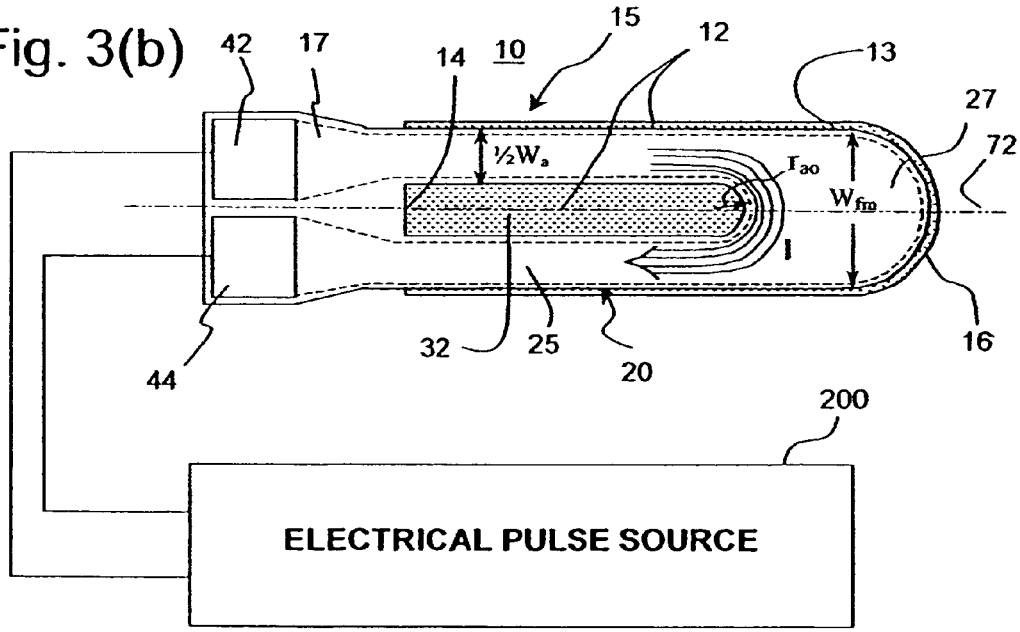

FIG. 3(*a*) illustrates a plan view of a single drop emitter unit 110 and a second plan view, FIG. 3(*b*), with the upper liquid chamber structure 28, including nozzle 30, removed. The single drop emitter design 110 illustrates a preferred embodiment of the present inventions. The thermal actuator 15, shown in phantom in FIG. 3*a* can be seen with solid lines in FIG. 3(*b*). Thermal actuator 15 is configured with a moving cantilevered element 20 having a through actuator opening 32. Cantilevered element 20 from anchor wall edge 14 of lower liquid chamber 12 which is formed in substrate 10. Cantilevered element anchor portion 17 is bonded to substrate 10 and anchors cantilevered element 20.

Cantilevered element 20 has the shape of a tongue, an extended flat shaft ending with a curved free end portion 27. The area of free end portion 27 is sized to cause sufficient fluid volume displacement adjacent nozzle 30 so that a liquid drop of the desired size is emitted. The lower fluid chamber 12 is formed slightly wider than cantilevered element 20, including a curved wall portion at 16 which conforms to the curvature of the free end portion 27, spaced away to provide clearance for the cantilevered element movement.

Actuator opening 32 is located in the center of the moving portion cantilevered element 20, but away from the fluid moving portion adjacent the nozzle, free end 27. Actuator opening 32 is symmetric about lengthwise axis 72 so as to counteract twisting tendencies about this axis. Actuator opening 32 has a curved shape of radius $r_{ao}$ at the end adjacent free end 27. For the embodiment illustrated in FIG. 3(*b*), $r_{ao}=(W_{fm}-W_a)/2$.

Actuator opening 32 contributes at least several functions to the liquid drop emitter. Firstly, it narrows the portion of the moving element, cantilevered element 20, that pushes and drags fluid during a drop emission event, saving energy. Secondly, it reduces the volume of the cantilevered element that is heated, also saving energy. Thirdly, the width reduction of the moving element is accomplished while retaining a wide effective stance arising from the two-armed nature of the resulting cantilever shaft, counteracting any tendencies for twisting. Fourthly, the current path within heater resistor 25 changes direction in the widest possible arc following a path outside radius $r_{ao}$ of actuator opening 32. And fifthly, actuator opening 32 provides a path for the refill of liquid from lower to upper liquid chambers without necessitating a wider drop emitter unit, thereby optimizing emitter packing density in an array of emitters.

FIG. 3(*b*) illustrates schematically the attachment of electrical pulse source 200 to the resistive heater 25 at interconnect terminals 42 and 44. Voltage differences are applied to voltage terminals 42 and 44 to cause resistance heating via u-shaped resistor 25. This is generally indicated by an arrow showing a current I. Because the current in resistor 25 courses around actuator opening 32, no current crowding condition occurs, hence no hot spot of excessive temperature excursion during operation. In the plan views of FIGS. 3(*a*) and 3(*b*), the actuator free end portion 27 moves toward the viewer when pulsed and drops are emitted toward the viewer from the nozzle 30 in upper liquid chamber structure 28

Figure 4:
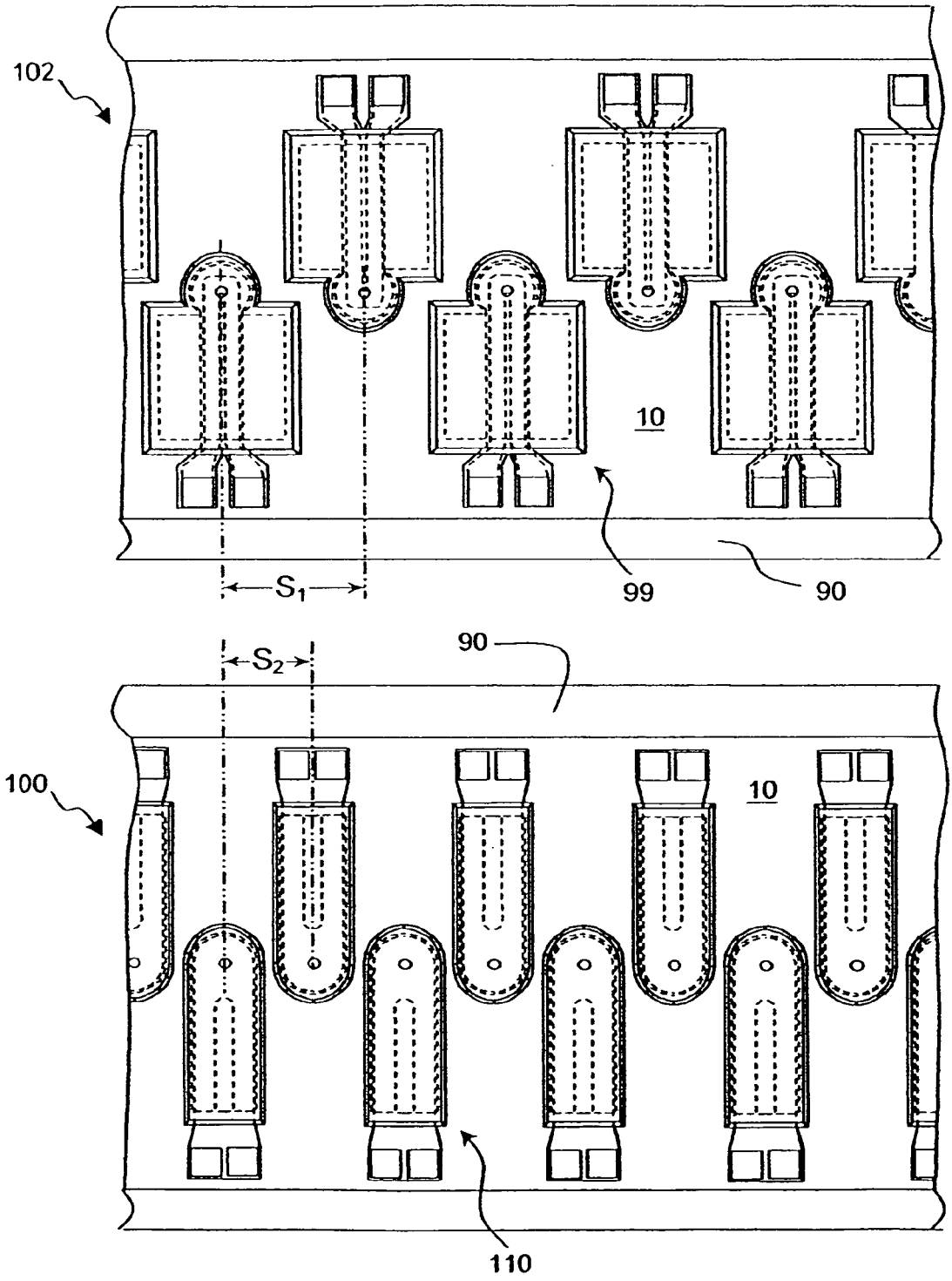
FIG. 4 is a plan view comparing the spacing of individual liquid drop emitters in an array for the liquid drop emitters illustrated in FIGS. 2(*a*) and 3(*a*)

FIG. 4 shows plan views of portions of two arrays of drop emitters forming ink jet printheads 100 and 102. Printhead 100 is formed using drop emitter units as illustrated in FIGS. 3(*a*) and 3(*b*) according to the present inventions. Printhead 102 is formed using a drop emitter unit without an actuator opening as illustrated in FIGS. 2(*a*) and 2(*b*). FIG. 4 illustrates that the array spacing, $S_2$, of drop emitter units 110, according to the present inventions, may be smaller than the array spacing, $S_1$, of drop emitter units 99 that are not configured using a through actuator opening 32. Since $S_2<S_1$, more drop emitter units may packed in the same space in printhead 100 as compared to printhead 102.

Element 90 of printhead 100 or 102 is a mounting structure which provides a mounting surface for microelectronic substrate 10 and other means for interconnecting the liquid supply, electrical signals, and mechanical interface features.

Figure 5A:
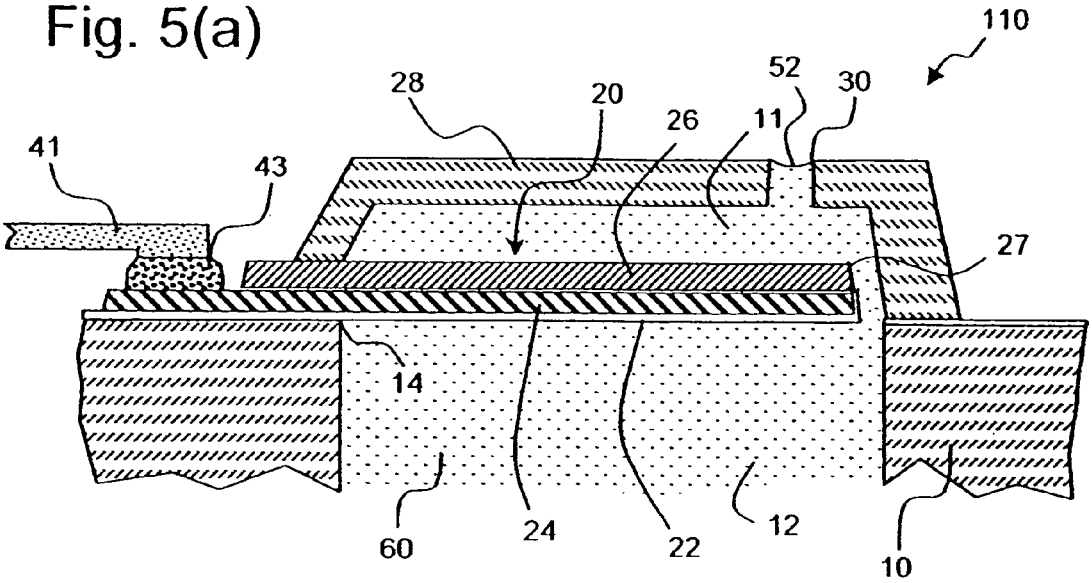
FIGS. 5(*a*) and 5(*b*) are side views formed along the line A—A in FIG. 3(*a*) illustrating first and second positions of the free end of a cantilevered element thermo-mechanical actuator according to the present invention.
Figure 5B:
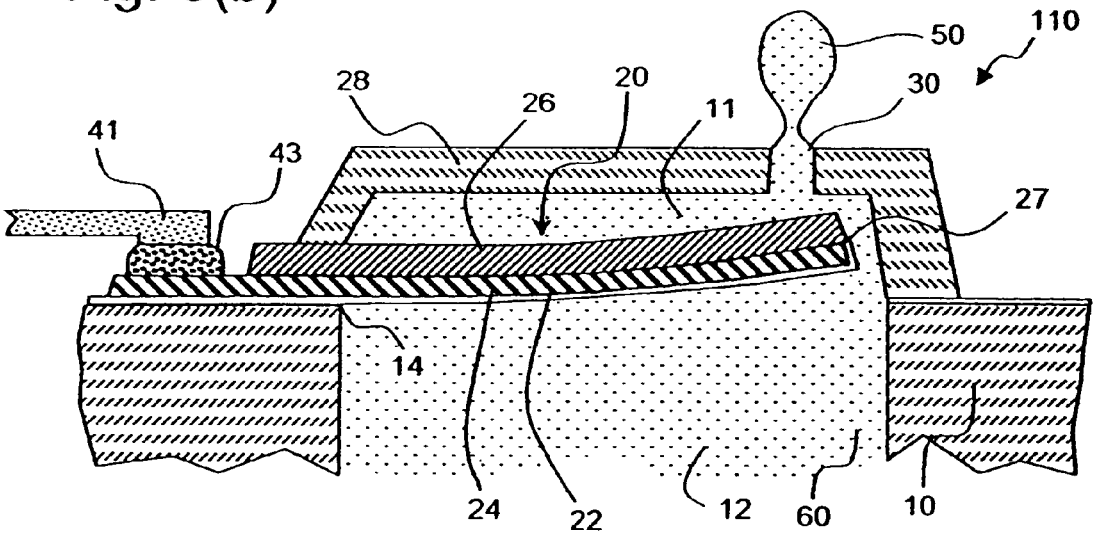

FIGS. 5(*a*)–5(*b*) illustrate, in sectional side view along line A—A, a liquid drop emitter 110 according to the preferred embodiment of the present invention illustrated in FIGS. 3(*a*) and 3(*b*). FIG. 5(*a*) shows the cantilevered element 20 in a first position proximate to nozzle 30. FIG. 5(*b*) illustrates the deflection of free end 27 of the cantilevered element 20 towards nozzle 30 to a second position. Rapid deflection of the cantilevered element to this second position pressurizes liquid 60 causing a drop 50 to be emitted.

In an operating emitter of the cantilevered element type illustrated, the quiescent first position may be a partially bent condition of the cantilevered element 20 rather than the horizontal condition illustrated FIG. 5(*a*). The actuator may be bent upward or downward at room temperature because of internal stresses that remain after one or more microelectronic deposition or curing processes. The device may be operated at an elevated temperature for various purposes, including thermal management design and ink property control. If so, the first position may be as substantially bent as is illustrated in FIG. 5(*b*).

For the purposes of the description of the present inventions herein, the cantilevered element will be said to be quiescent or in its first position when the free end is not significantly changing in deflected position. For ease of understanding, the first position is depicted as horizontal in FIG. 5(*a*). However, operation of thermal actuators about a bent first position are known and anticipated by the inventors of the present invention and are fully within the scope of the present inventions.

Cantilevered element 20 is constructed of several layers. Deflector layer 24 causes upward deflection when it is thermally elongated with respect to other layers in the cantilevered element 20. It is constructed of an electrically resistive material, preferably intermetallic titanium aluminide, that has a large coefficient of thermal expansion. A low expansion layer 26 is attached to the deflector layer 24. The low expansion layer 26 is constructed of a material having a low coefficient of thermal expansion, with respect to the material used to construct the deflector layer 24. The thickness of low expansion layer 26 is chosen to provide the desired mechanical stiffness and to maximize the deflection of the cantilevered element for a given input of heat energy. Low expansion layer 26 may also be a dielectric insulator to provide electrical insulation for resistive heater segments and current coupling devices formed into the deflector layer. The low expansion layer may be used to partially define electroresistor and coupler segments formed as portions of deflector layer 24.

Low expansion layer 26 may be composed of sub-layers, laminations of more than one material, so as to allow optimization of functions of heat flow management, electrical isolation, and strong bonding of the layers of the cantilevered element 20.

Passivation layer 22 shown in FIG. 5 is provided to protect the deflector layer 24 chemically and electrically. Such protection may not be needed for some applications of thermal actuators according to the present invention, in which case it may be deleted. Liquid drop emitters utilizing thermal actuators which are touched on one or more surfaces by the working liquid may require passivation layer 22 which is chemically and electrically inert to the working liquid.

A heat pulse is applied to deflector layer 24, causing it to rise in temperature and elongate. Low expansion layer 26 does not elongate nearly as much because of its smaller coefficient of thermal expansion and the time required for heat to diffuse from deflector layer 24 into low expansion layer 26. The difference in length between deflector layer 24 and the low expansion layer 26 causes the cantilevered element 20 to bend upward as illustrated in FIG. 5(*b*). The bending response of the cantilevered element 20 must be rapid enough to sufficiently pressurize the liquid at the nozzle. Typically, electroresistive heating apparatus is adapted to apply heat pulses and an electrical pulse duration of less than 4 μsecs. is used and, preferably, a duration less than 2 μsecs.

FIGS. 6 through 17 illustrate fabrication processing steps for constructing a single liquid drop emitter according to some of the preferred embodiments of the present invention. For these embodiments the deflector layer 24 is constructed using an electrically resistive material, such as titanium aluminide, and a portion is patterned into a resistor for carrying electrical current, I.

Figure 6:
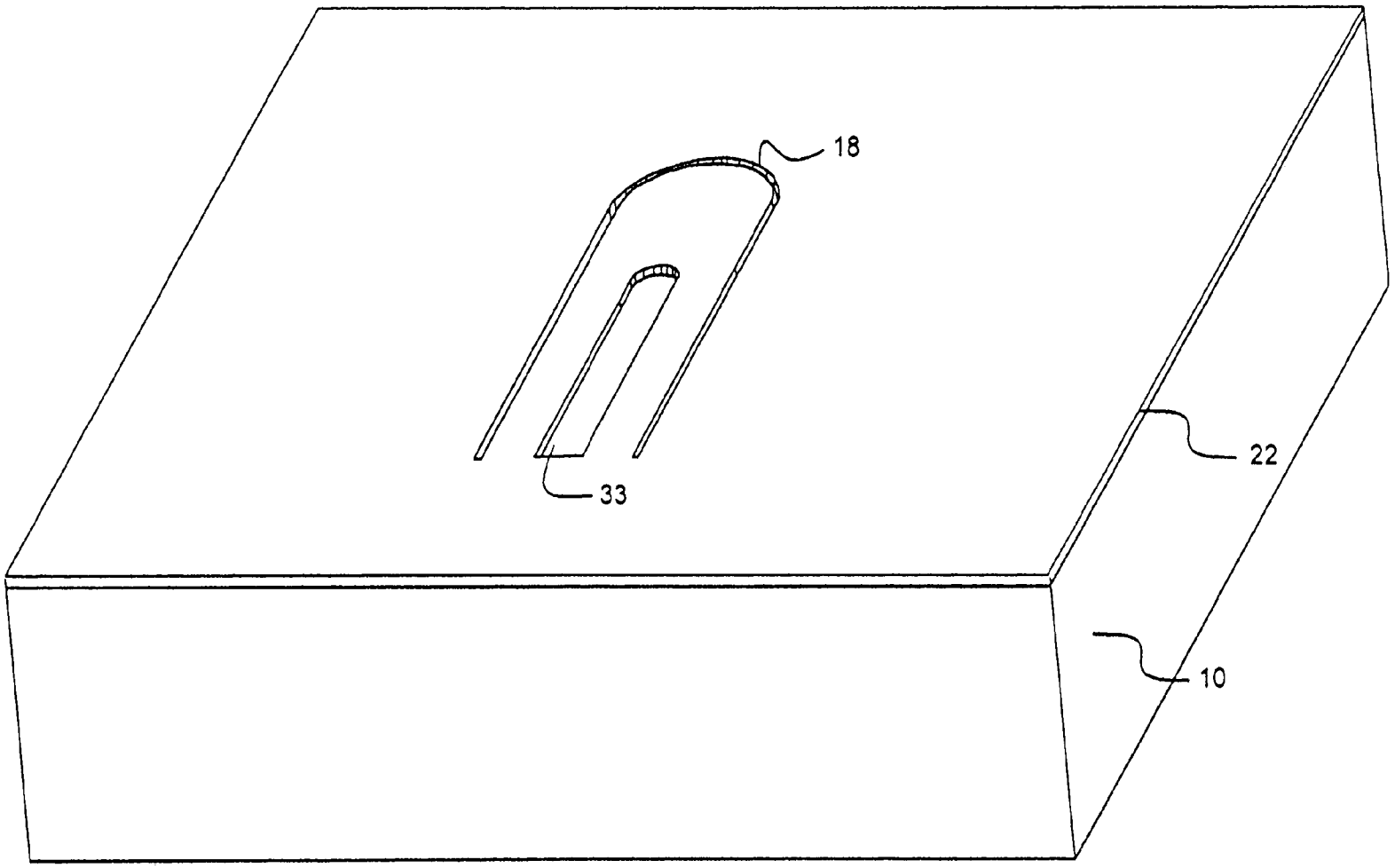
FIG. 6 is a perspective view of the initial stages of a process suitable for constructing a thermo-mechanical actuator according to the present invention wherein a passivation layer of a cantilevered element is formed.

FIG. 6 illustrates a perspective view of a single cantilevered element at an initial stage of a manufacturing process. Passivation layer 22 has been formed of a passivation material on substrate 10. The passivation material has been removed in a bottom layer pattern so that the substrate is now exposed in some areas. The refill opening 33 in passivation layer 22 will eventually allow liquid refill from the lower liquid chamber 12 through actuator opening 32 to upper liquid chamber 11. A clearance gap 18 will allow cantilevered element 20 to be released from substrate 10 at a later fabrication stage. Passivation layer 22 remains in the movable areas of cantilevered element 20 to protect the deflector layer from contact with the working liquid or ink.

The passivation material for the cantilevered element thermal actuator is deposited as a thin layer so to minimize its impedance of the upward deflection of the finished actuator. A chemically inert, pinhole free material is preferred so as to provide chemical and electrical protection of the deflector material which will be formed on the bottom layer. A preferred method of the present inventions is to use silicon wafer as the substrate material and then a wet oxidation process to grow a thin layer of silicon dioxide. Alternatively, a high temperature chemical vapor deposition of a silicon oxide, nitride or carbon film may be used to form a thin, pinhole free dielectric layer with properties that are chemically inert to the working fluid.

Figure 7:
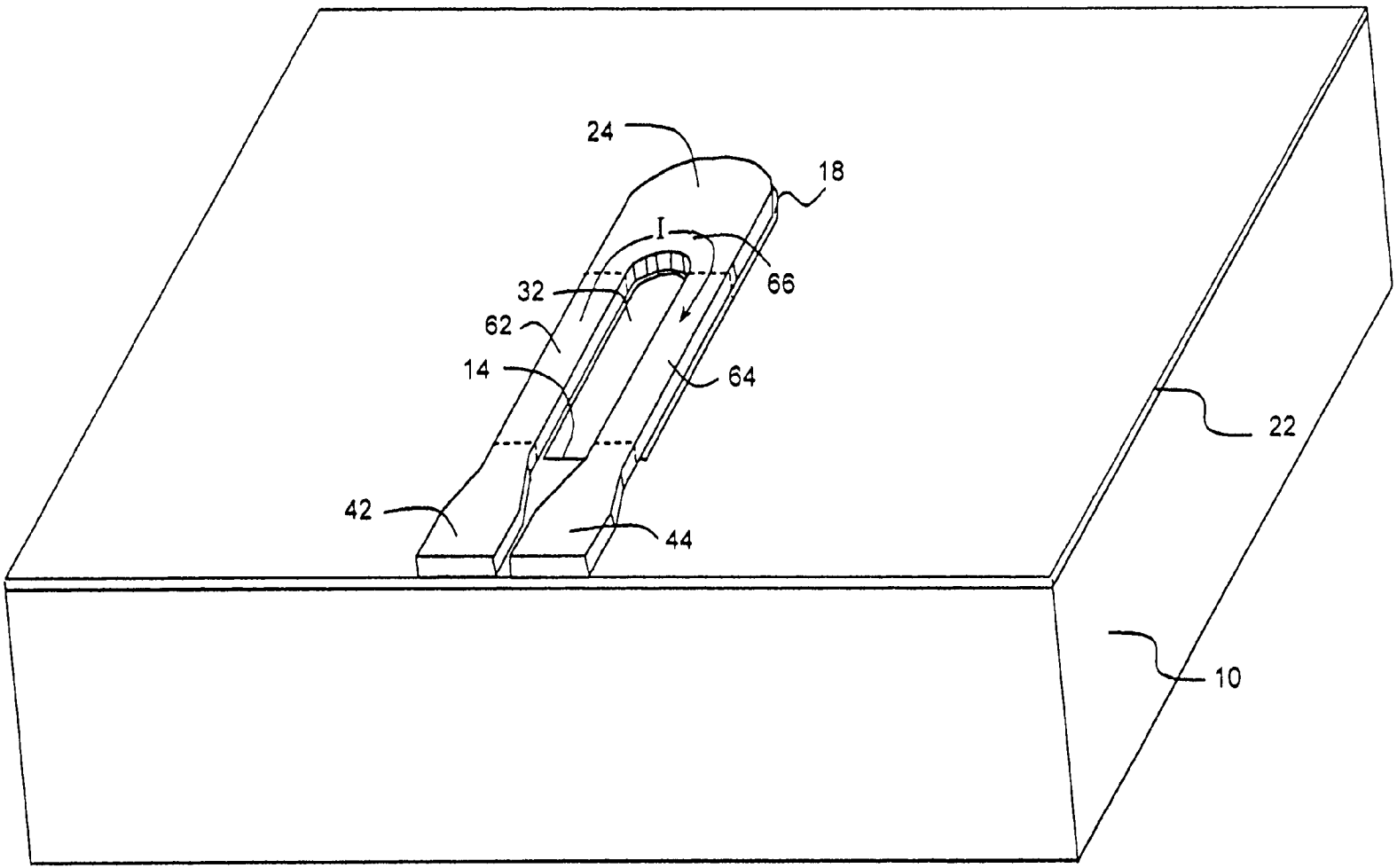
FIG. 7 is a perspective view of the next process stage for constructing some preferred embodiments of a thermo-mechanical actuator according to the present invention wherein a deflector layer of an electrically resistive deflector material of the cantilevered element is formed.

FIG. 7 illustrates perspective view of a next fabrication process sequence in which a deflector layer 24 is added. The illustrated structure is formed on a substrate 10, for example, single crystal silicon, by standard microelectronic deposition and patterning methods. A portion of substrate 10 will also serve as a base element from which cantilevered element 20 extends. A preferred deflector material is intermetallic titanium aluminide. Deposition of intermetallic titanium aluminide may be carried out, for example, by RF or pulsed DC magnetron sputtering. An example deposition process that may be used for titanium aluminide is described in U.S. Pat. No. 6,561,627 for "Thermal Actuator", assigned to the assignee of the present invention.

First and second resistor segments 62 and 64 are formed in deflector layer 24 by removing a pattern of the electrically resistive material. In addition, a current coupling segment 66 is formed in the deflector layer material which conducts current serially between the first resistor segment 62 and the second resistor segment 64. The current path is indicated by an arrow and letter "I". Coupling segment 66, formed in the electrically resistive material, will also heat the cantilevered element when conducting current. However this coupler heat energy, being introduced at the free end of the cantilever, is not important or necessary to the deflection of the thermal actuator. The primary function of coupler segment 68 is to reverse the direction of current.

Addressing electrical leads 42 and 44 are illustrated as being formed in the deflector layer 24 material as well. Leads 42, 44 may make contact with circuitry previously formed in base element substrate 10 or may be contacted externally by other standard electrical interconnection methods, such as tape automated bonding (TAB) or wire bonding.

Figure 8:
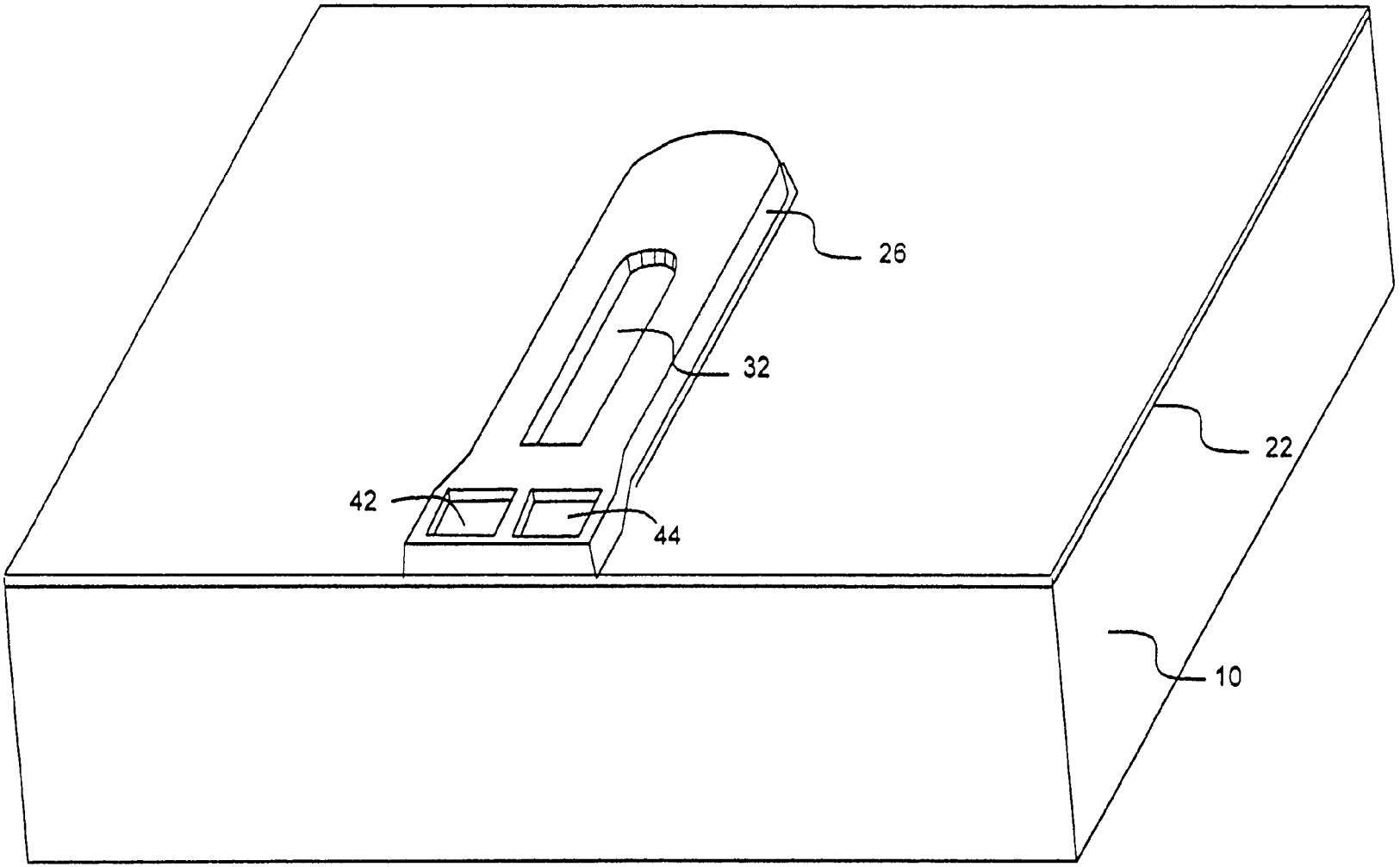
FIG. 8 is a perspective view of a next process stage for some preferred configurations the present invention wherein a low expansion layer of a low thermal expansion material is formed.

FIG. 8 illustrates a low expansion layer 26 having been deposited and patterned over the previously formed deflector layer 24 portion of the thermal actuator. Low expansion layer 26 is formed over the deflector layer 24 covering the resistor pattern. The low expansion layer 26 material has low coefficient of thermal expansion compared to the material of deflector layer 24. For example, low expansion layer 26 may be silicon dioxide, silicon nitride, aluminum oxide or some multi-layered lamination of these materials or the like. Additional passivation materials may be applied at this stage over the low expansion layer 26 for chemical and electrical protection.

Figure 9:
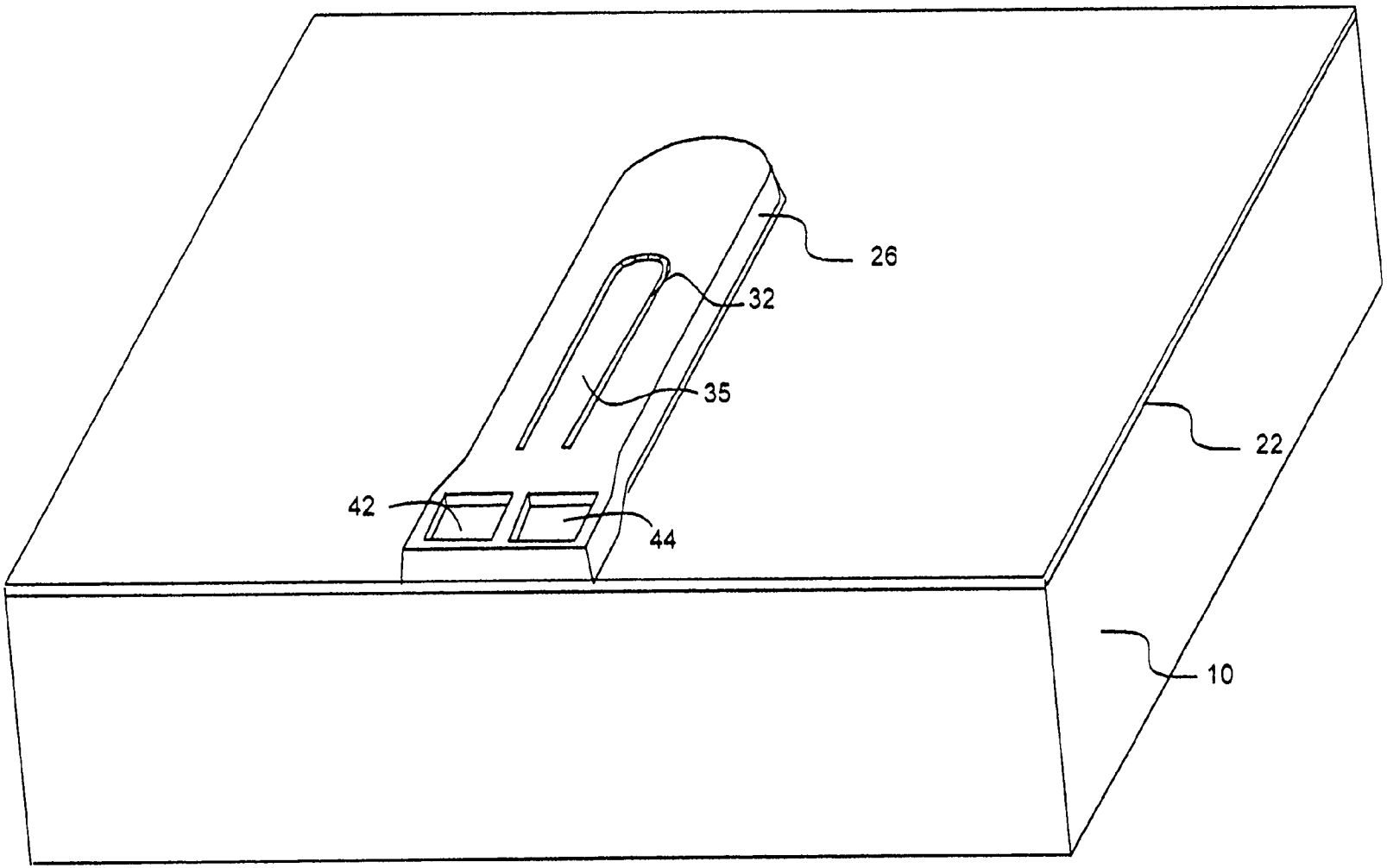
FIG. 9 is a perspective view of a next process stage for some alternate preferred configurations the present invention wherein a low expansion layer of a low thermal expansion material is formed.

FIG. 9 illustrates in perspective view a low expansion layer 26 having been deposited and patterned over a previously formed deflector layer 24 portion of a cantilevered element having an alternate configuration according to the present inventions. In this alternate embodiment of the present inventions, actuator opening 32 is formed as a slot outlining a central portion 35 of cantilevered element 20. This will result in rendering the central portion 35 as stationary rather than fully removed.

Figure 10:
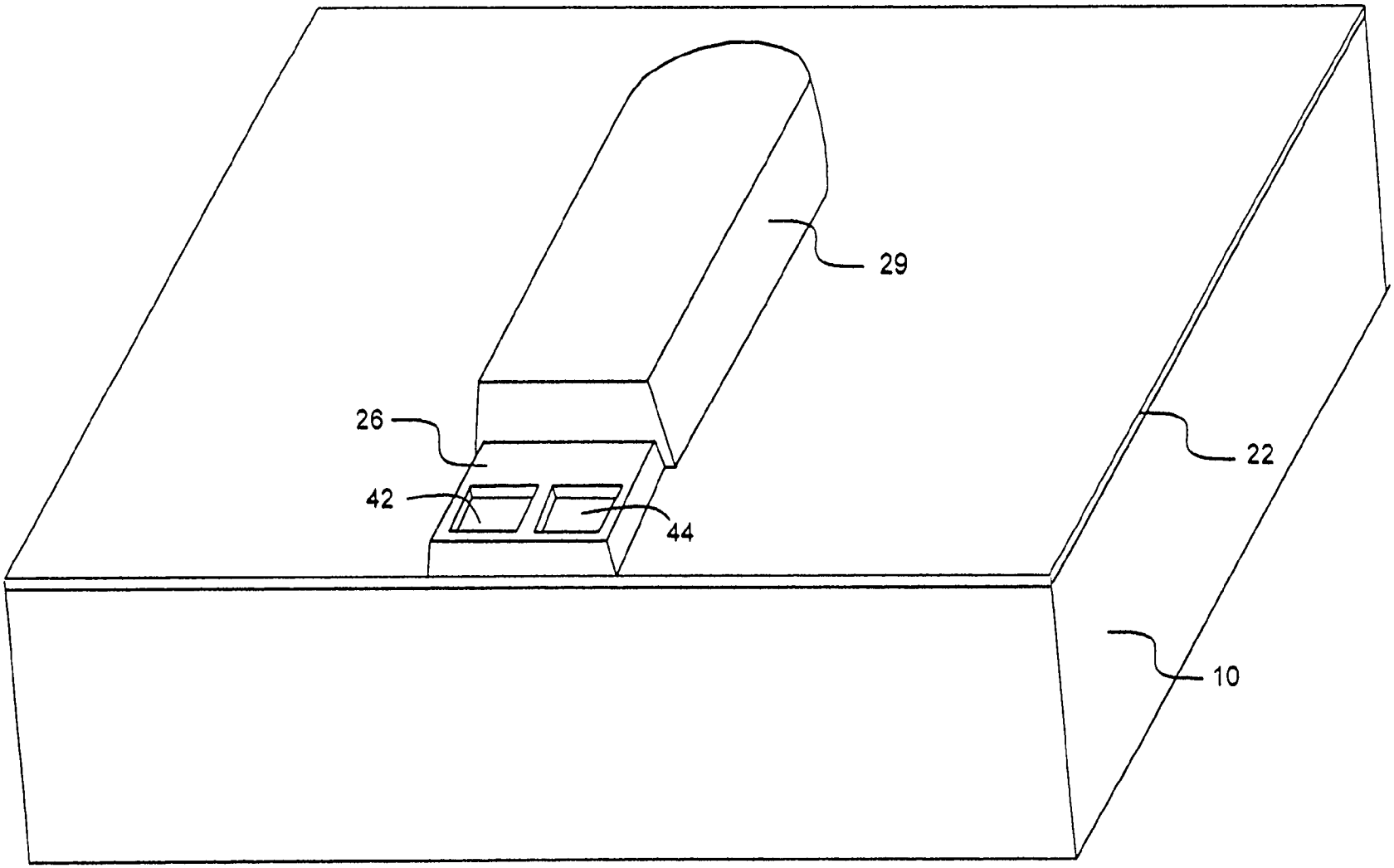
FIG. 10 is a perspective view of the next stages of the process illustrated in FIG. 8 or 9 wherein a sacrificial layer in the shape of the liquid filling an upper chamber of a liquid drop emitter according to the present invention is formed.

FIG. 10 shows the addition of a sacrificial layer 29 which is formed into the shape of the interior of a chamber of a liquid drop emitter. A suitable material for this purpose is polyimide. Polyimide is applied to the device substrate in sufficient depth to also planarize the surface which has the topography of the passivation 22, deflector 24 and low expansion 26 layers as illustrated in FIGS. 6–9. Any material which can be selectively removed with respect to the adjacent materials may be used to construct sacrificial structure 29.

Figure 11:
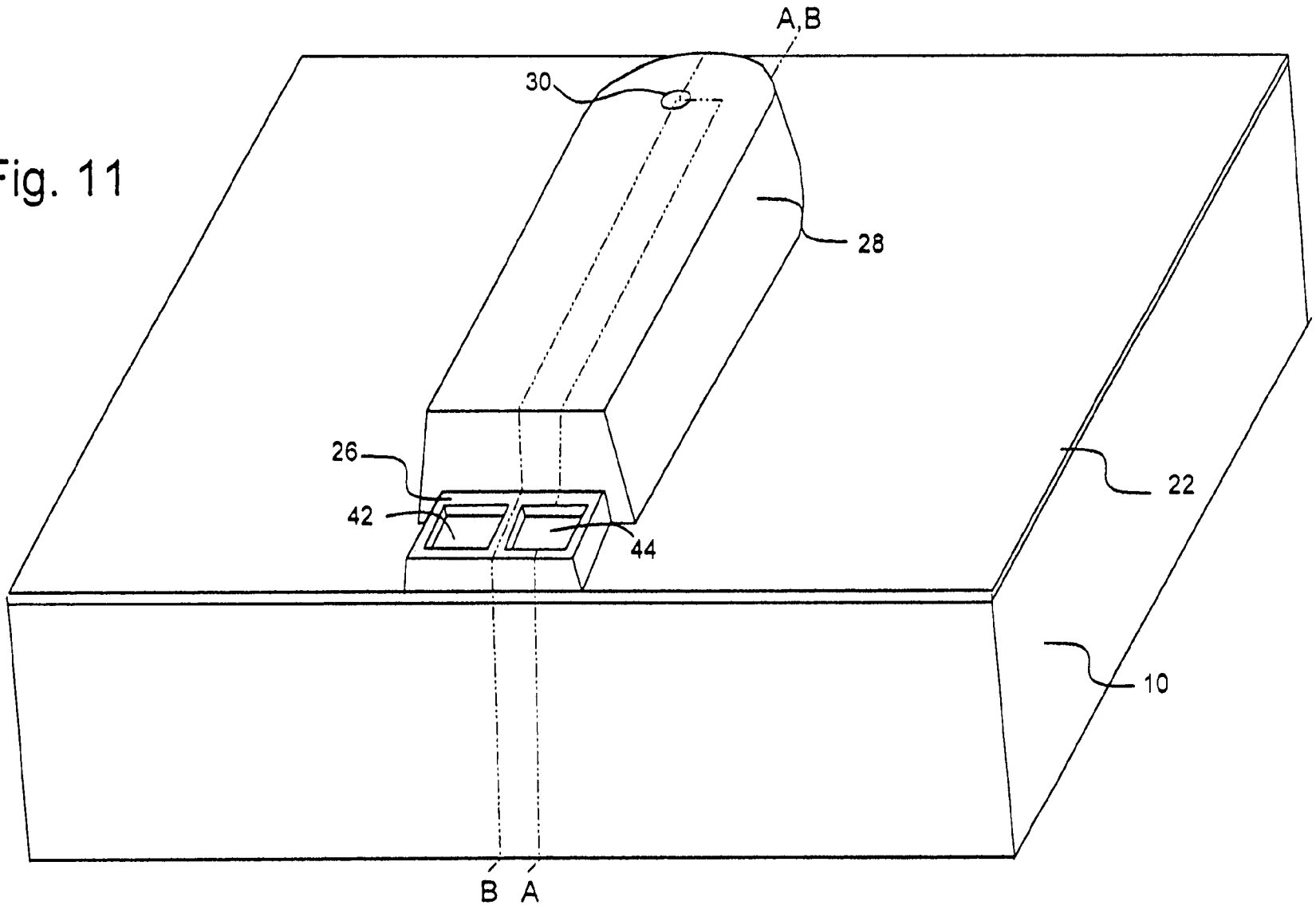
FIG. 11 is a perspective view of the next stages of the process illustrated in FIGS. 6–10 wherein an upper liquid chamber and nozzle of a drop emitter according to the present invention are formed.
Figure 12A:
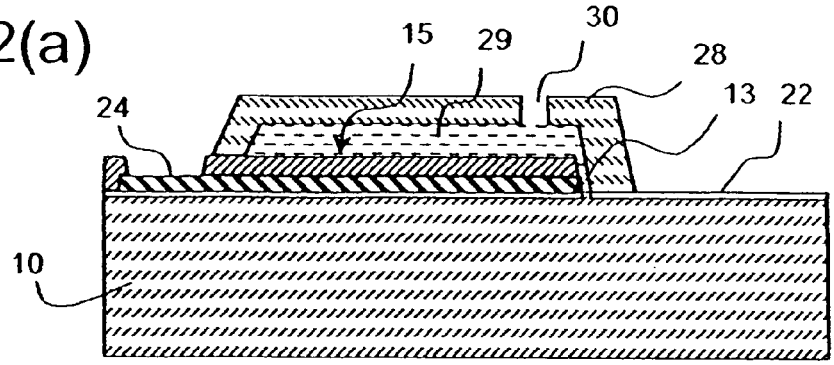
FIGS. 12(*a*)–12(*d*) are side views of the final stages of the process illustrated in FIGS. 6–11 wherein a liquid supply pathway is formed and the sacrificial layer is removed to complete a liquid drop emitter according to the present invention.
Figure 12B:
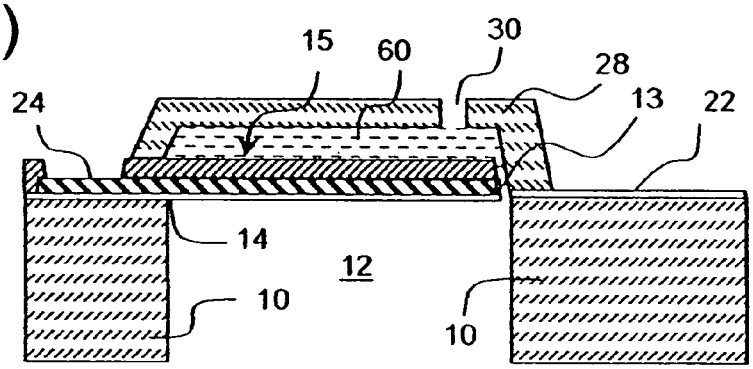
Figure 12C:
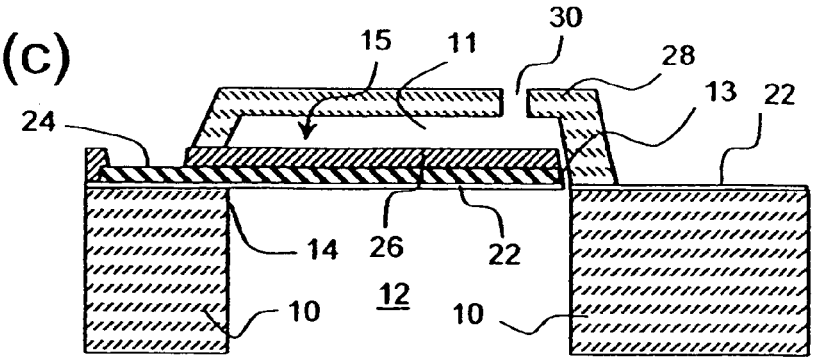
Figure 12D:
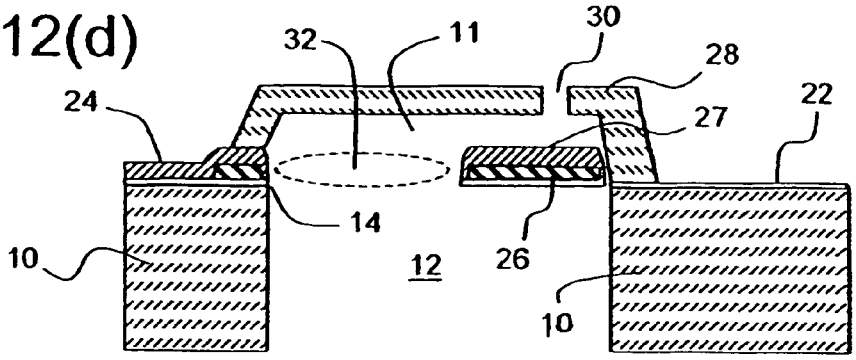

FIG. 11 illustrates drop emitter liquid chamber walls and cover formed by depositing a conformal material, such as plasma deposited silicon oxide, nitride, or the like, over the sacrificial layer structure 29. This layer is patterned to form drop emitter upper chamber structure 28. Nozzle 30 is formed in the drop emitter chamber structure 28, communicating to the sacrificial material layer 29, which remains within the drop emitter chamber structure 28 at this stage of the fabrication sequence.

FIGS. 12(*a*)–12(*c*) illustrate side views of the emitter through a section indicated as A—A in FIG. 11. FIG. 12(*d*) illustrates a side view of the emitter through a section indicated as B—B in FIG. 11 employing the cantilever design of FIG. 8. In FIG. 12(*a*) the sacrificial layer 29 is enclosed within the drop emitter chamber structure 28 except for nozzle opening 30. Also illustrated in FIG. 12(*a*), the substrate 10 is intact. Passivation layer 22 has been removed from the surface of substrate 10 in gap area 13 around the periphery of the cantilevered element 20. Passivation layer 22 has also been removed from beneath actuator opening 32 (not shown).

In FIG. 12(*b*), substrate 10 is removed beneath the cantilever element 20 and the liquid chamber areas around and beside the cantilever element 20. The removal may be done by an anisotropic etching process such as reactive ion etching, or such as orientation dependent etching for the case where the substrate used is single crystal silicon.

In FIG. 12(*c*) the sacrificial material layer 29 has been removed by dry etching using oxygen and fluorine sources. The etchant gasses enter via the nozzle 30 and from the newly opened fluid supply chamber area 12, etched previously from the backside of substrate 10. This step releases the cantilevered element 20 and completes the fabrication of a liquid drop emitter structure. FIG. 12(*d*) illustrates the final fabrication stage as in FIG. 12(*c*) except in a side view through section B—B indicated in FIG. 11. The free end 27 of the cantilevered element 20 appears disconnected from the anchor wall 14 because of the presence of through actuator opening 32 along this section generally indicated by phantom line oval. The cantilevered element illustrated in FIG. 8 is illustrated in FIG. 12(*d*).

FIGS. 13–16 illustrate alternate preferred embodiments of the present inventions wherein a very narrow actuator opening of a width just sufficient for clearance is employed. The narrow actuator opening delineates a central portion of the cantilevered element that will remain stationary when the cantilevered element is caused to deflect.

Figure 13:
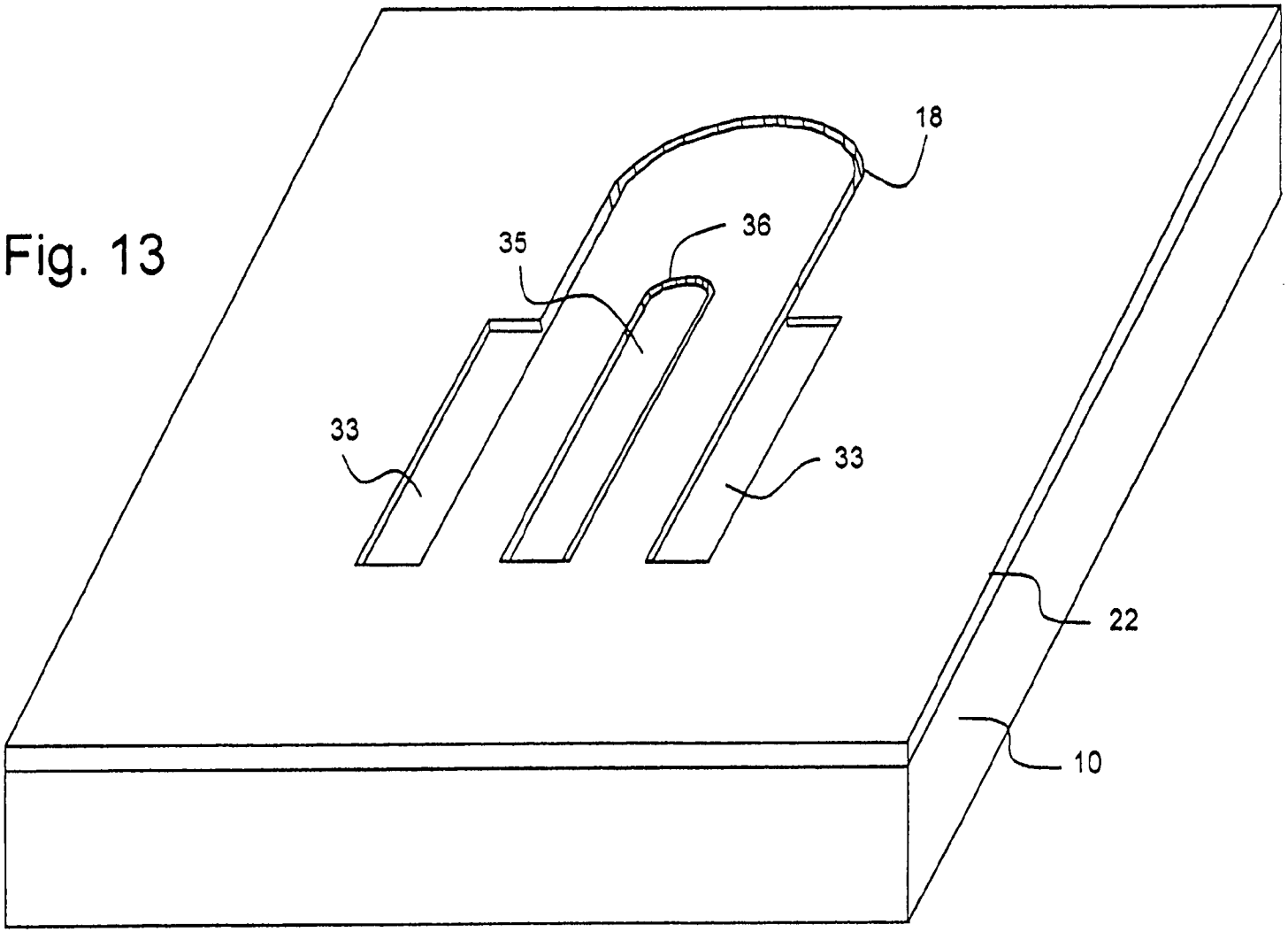
FIG. 13 is a perspective view of a passivation layer design for an alternate preferred embodiment of the present inventions.

FIG. 13 illustrates in perspective view the patterned passivation layer 22 on substrate 10. Passivation layer 22 is removed in free edge area 18 on around the outer periphery of the cantilevered element. Passivation layer 22 is also removed in the area of the narrow actuator opening 36. In addition, passivation layer 22 is removed in outer refill areas 33 in order to provide sufficient refill cross section from eventual lower liquid chamber 12 to upper liquid chamber 11 around the cantilevered element 20.

If narrow actuator opening 36 provides enough fluid refill cross section up around central stationary portion 35, then refill areas 33 may be eliminated and free edge area 18 extended instead to fully release cantilevered element 20. This configuration is illustrated in FIG. 9.

The preferred amount of total cross sectional area for refill provided by one or more actuator openings 32 is related to the area of nozzle 30, $A_n$. The amount of liquid which will flow out during a drop emission event is scaled by $A_n$. The total refill area which allows liquid to replace the emitted liquid volume is preferably at least a large as the nozzle area, $A_n$, otherwise the time for refill will be unduly restricted and drop repetition frequency severely limited. On the other hand, if the amount of refill area is too large, then excessive pressure pulse energy will be lost to the large refill pathway, compromising drop emission velocity, or requiring additional pressure pulse energy to be used per emission event. The refill cross sectional area is preferably designed to less than $10A_n$ to balance drop repetition frequency goals with energy efficiency and drop velocity goals.

For the present inventions, liquid refill may occur both around the thermal actuator moving element and through openings in the moving element. Several embodiments of the present inventions seek to promote spatial packing density and heat dissipation by employing through actuator openings as a primary fluid refill pathway. Therefore, some preferred embodiments of the present invention are configured so that the total cross sectional area of the one or more actuator openings, $A_m$, have the above discussed relationship to nozzle area: $A_n<A_m<10\ A_n$.

The addition of refill areas 33 in the configuration illustrated in FIGS. 13–16 may compromise the emitter spatial packing efficiency as compared to the design illustrated in FIGS. 3(*a*) and 3(*b*). However, the close proximity of central stationary portion 35 provides the opportunity to dissipate heat from adjacent heated portions of cantilevered element 20. For some applications the higher frequency operation enabled by the more efficient heat dissipation pathway may be more important than optimizing emitter packing density.

Figure 14:
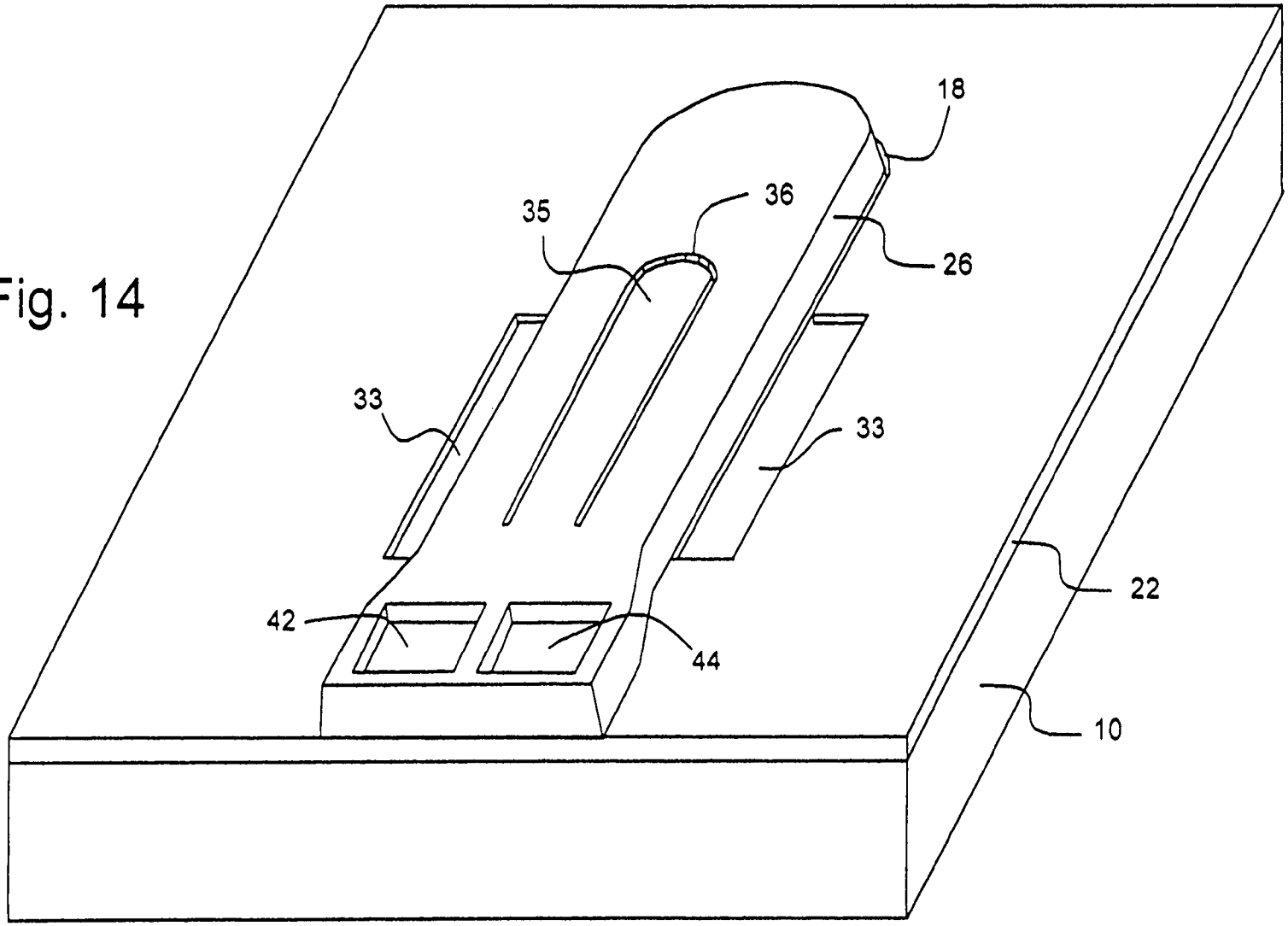
FIG. 14 is a perspective view of a low expansion layer design for the alternate configuration illustrated in FIG. 13.
Figure 15:
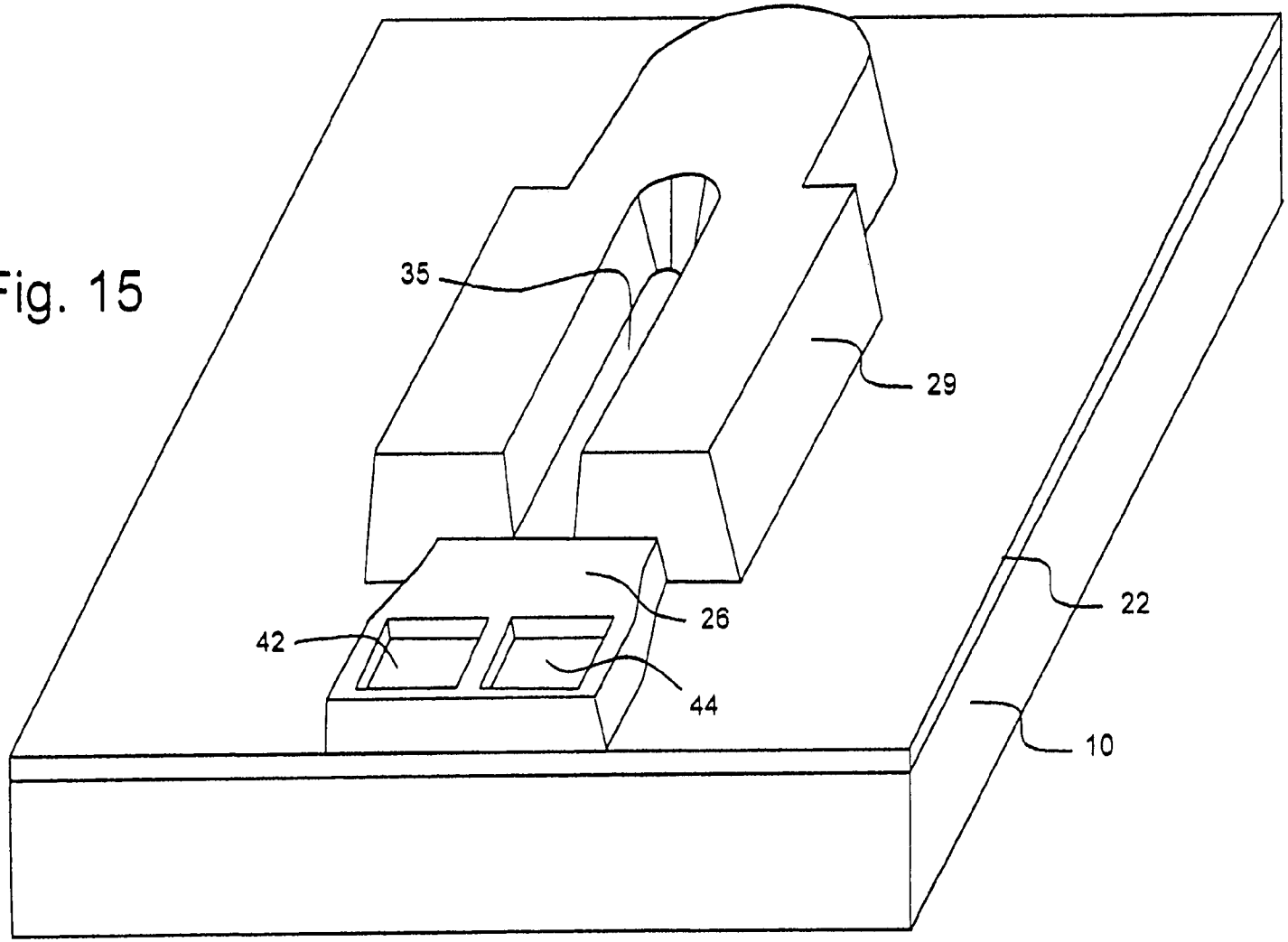
FIG. 15 is a perspective view of a sacrificial layer design for the alternate configuration illustrated in FIGS. 13 and 14.

FIG. 14 illustrates in perspective view the configuration of FIG. 13 processed to add deflection and low expansion layers. In FIG. 15 a sacrificial layer 29 pattern has been added. The sacrificial layer is omitted from the central stationary portion 35 except for an overlapping edge around its perimeter (not shown). This pattern will allow the subsequent upper chamber structure material to descend to and fill the space above the central stationary portion while allowing the inner edges of the cantilevered element 20 to be freed when the sacrificial material is later removed.

Figure 16:
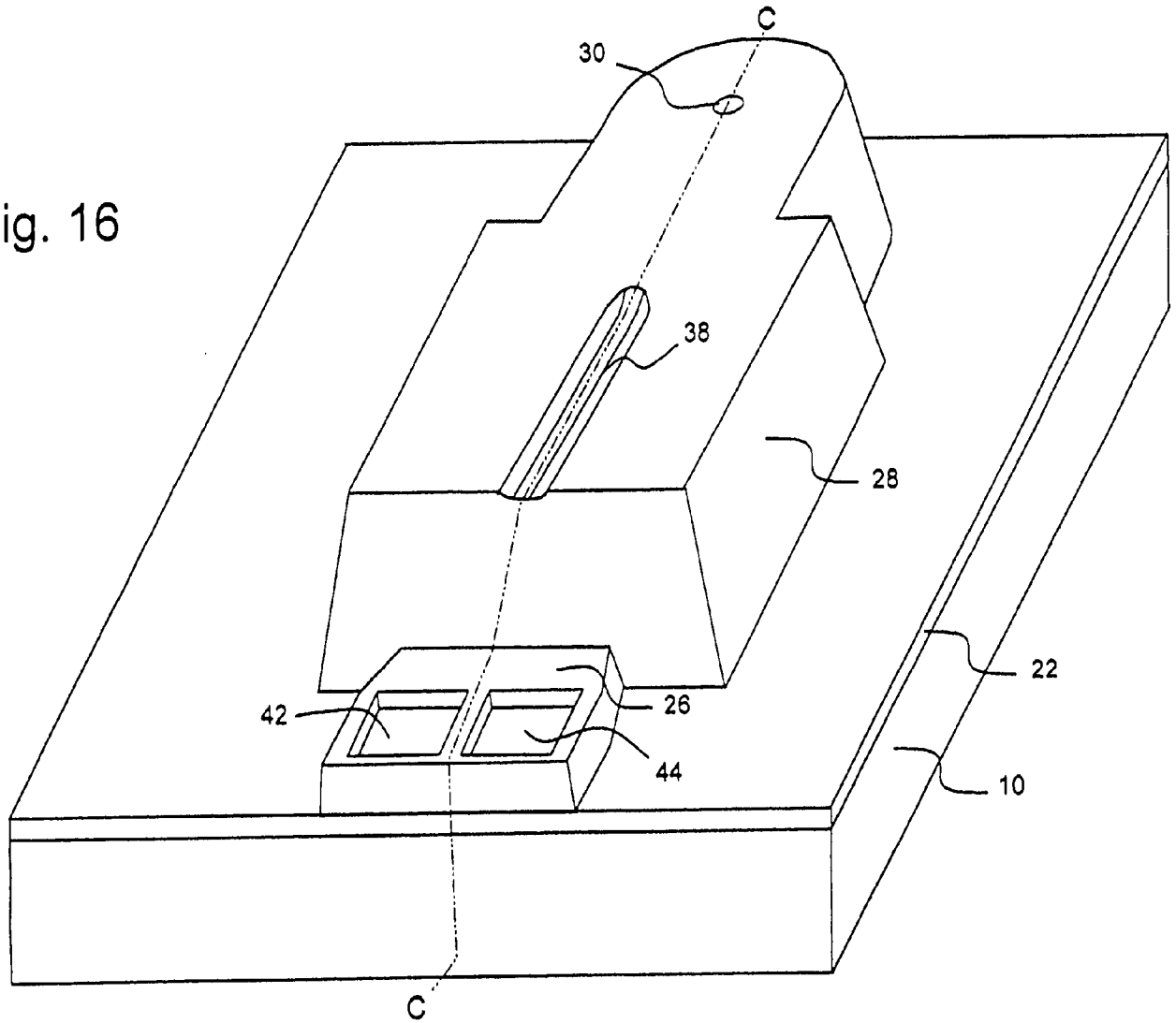
FIG. 16 is a perspective view of an upper liquid chamber layer design for the alternate configuration illustrated in FIGS. 13–15.

FIG. 16 shows in perspective view the formation of upper liquid chamber structure 28. A hint of the central stationary portion 35 of the cantilevered element is shown on the drawing as a depression 38. If a sufficiently planarizing material deposition process were used to form layer 28 before patterning, depression 38 would not remain visible. The liquid drop emitter fabrication processes illustrated in FIGS. 12(*a*)–12(*d*) are applied in analogous fashion to the intermediate structure of FIG. 16 to complete the device. A side view of a completed device according to this embodiment taken along line C—C is illustrated in FIGS. 18(*a*) and 18(*b*) and discussed below.

Figure 17:
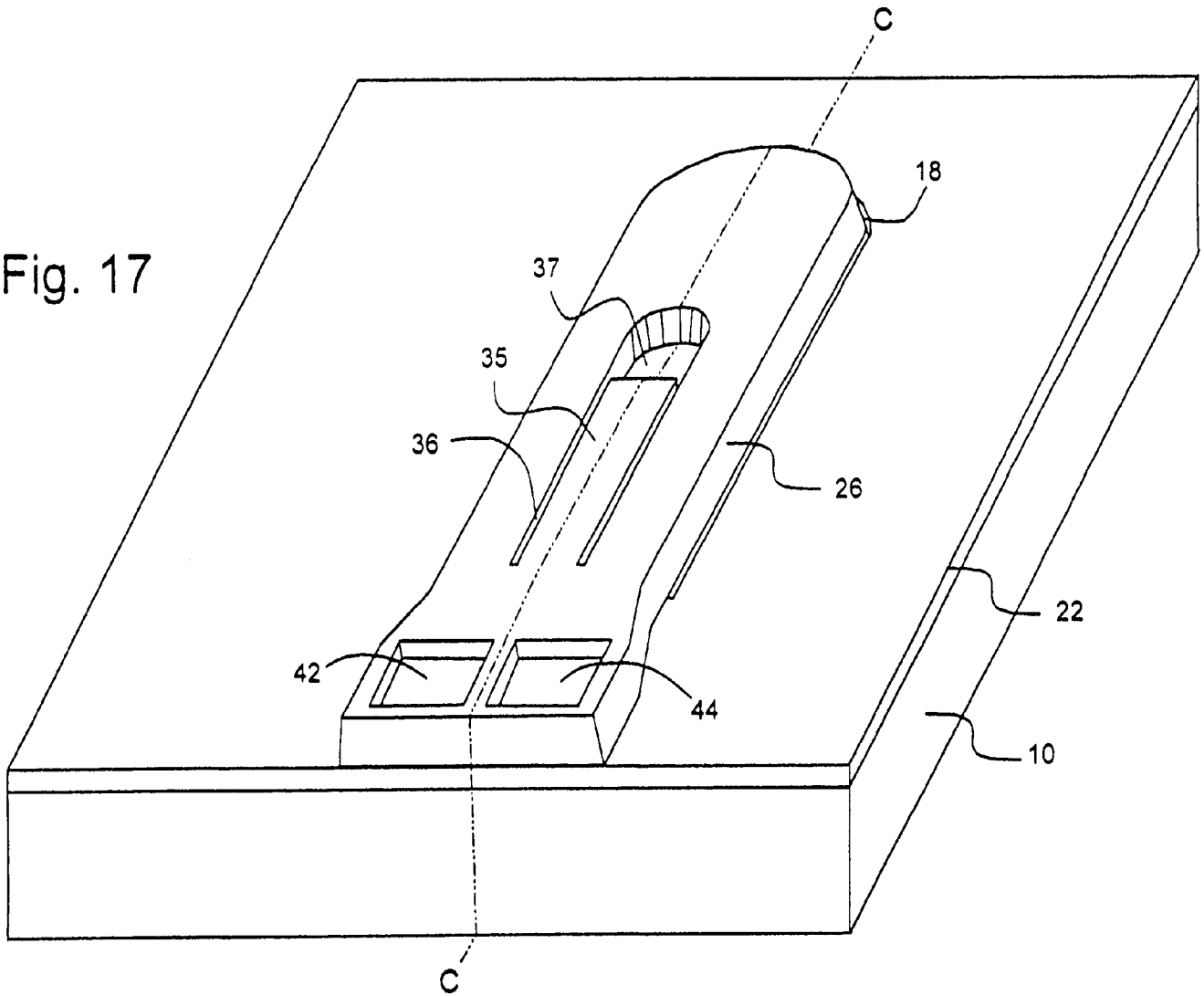
FIG. 17 is a perspective view of another preferred embodiment of the present inventions after forming the low expansion layer.

An additional embodiment of the present inventions is illustrated in perspective view in FIG. 17. This embodiment is depicted at the fabrication process wherein the low expansion layer is formed. This alternate design represents a compromise between the designs illustrated in FIGS. 8 and 14. A fraction of a central stationary portion 35 delineated by a narrow actuator opening 36 is removed to provide a larger liquid refill opening 37 in the actuator, thereby eliminating the need for auxiliary refill passages around the outside edges of cantilevered element 20.

Figure 18A:
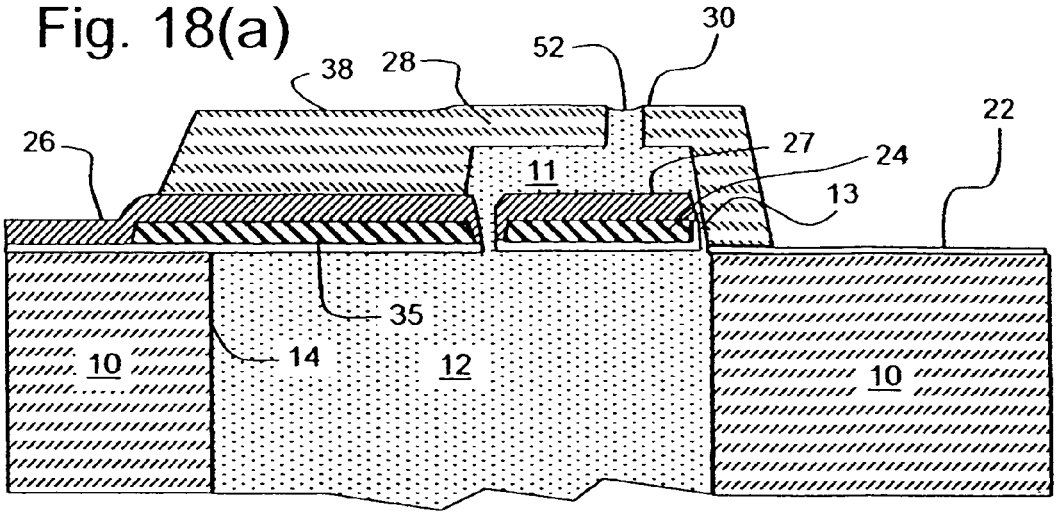
FIGS. 18(*a*)–18(*c*) are side views of completed liquid drop units according to the designs illustrated in FIGS. 13–17.
Figure 18B:
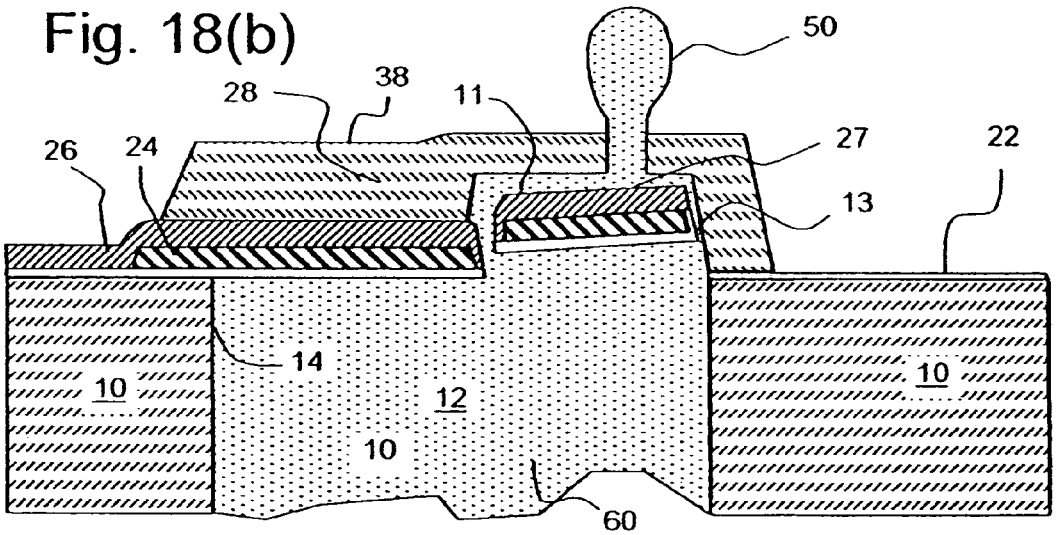
Figure 18C:
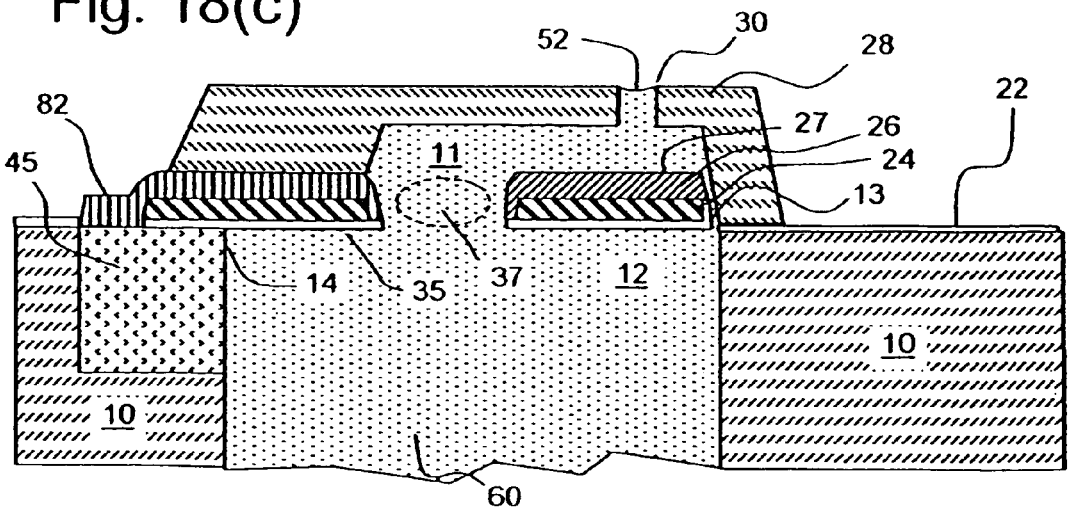

FIGS. 18(*a*) and 18(*b*) illustrate in sectional side view a liquid drop emitter of the configuration illustrated in FIGS. 13–16, taken along line C—C of FIG. 16. FIG. 18(*a*) illustrates the cantilevered element in a quiescent first position. Free end portion 27 is proximate to nozzle 30. Central stationary portion 35, attached by a post-like fill of chamber structure material to the upper liquid chamber structure 28, is seen in this cross section. The anchor wall portion of the upper chamber structure 28 is extended to cover central stationary portion 35. The post of chamber structure material provides mechanical strength to the upper liquid chamber structure cavity. This cavity must resist external pressures applied during any wiping procedures used to maintain clean nozzles. In addition, the added mass of chamber structure material in thermal contact with the central stationary portion of the cantilevered element provides an additional heat dissipation pathway. FIG. 18(*b*) illustrates this embodiment when the cantilevered element has been deflected to a second position to emit a liquid drop.

FIG. 18(*c*) illustrates a sectional side view of a completed liquid drop emitter according to the embodiment of the present inventions illustrated in FIG. 17, taken along section C—C. The cantilevered element is shown in a quiescent first position. A truncated central stationary portion 35 is shown attached to the upper liquid chamber structure in analogous fashion to the embodiment illustrated in FIGS. 18(*a*) and 18(*b*).

The through actuator opening 32 has a large area for liquid refill 37 which is indicated by a phantom oval in FIG. 18(*c*). The size of this opening may be adjusted to provide a desired balance between rapid refill and loss of ejection pressure. Rapid liquid refill of the upper chamber 11 is desirable to support high drop emission frequencies. Resistance to "backward" flow, i.e. towards the ink supply, is desirable to promote efficiency of drop emission and high drop velocities. The actuator opening 32 in cantilevered element 20 changes somewhat as the moving portion of the actuator changes position. This "dynamic" refill opening characteristic may also be exploited to realize a higher resistance to backflow at the beginning of a deflection, hence, drop emission, event while having a larger refill opening at the peak of the cantilevered element 20 movement.

An additional feature of some embodiments of the present inventions, heat dissipation element 82, is illustrated in FIG. 18(*c*). Heat dissipation element 82 is formed onto the central stationary portion using a heat dissipation material having high thermal conductivity. In the embodiment illustrated in FIG. 18(*c*), low expansion layer 26 has been removed from the central stationary portion 35 and a high thermal conductivity material deposited over the deflector layer 24. In addition, a heat sink portion 45 of substrate 10 is provided. For the case wherein substrate 10 is formed of a silicon wafer material, heat sink portion 45 may simply be a designated volume of silicon near anchor wall 14. For substrates 10 which are less thermally conductive, heat sink portion 45 may be formed or embedded using another high thermal conductivity material.

Heat dissipation element 82 is formed to make good thermal contact with heat sink portion 45. To facilitate good thermal contact, passivation layer 22 material has been removed in a contact area adjacent anchor wall 14. This arrangement provides a more thermally conductive pathway for dissipating heat from the heated portions of the cantilever element 20 adjacent central stationary portion 35.

Alternative embodiments of the present inventions may be formed by incorporating a heat dissipation material onto the central stationary portion 35 in any combination with the other fabrication layers. That is, the heat dissipation material could replace any, all or none of the passivation, deflector, low expansion and chamber structure materials in the central stationary portion 35. Since the central stationary portion 35 is located adjacent the heated portions of cantilevered element 20, this is an ideal location at which to position materials which have high thermal conductivity and heat capacity. From the perspective of maximum heat dissipation, the passivation, deflector, low expansion materials could be removed from the central stationary portion 35 prior to the formation of the sacrificial layer pattern 29 illustrated in FIG. 15. A high thermal conductivity material could then be deposited to substantially fill the volume above the central stationary portion 35 and make thermal contact with the heat sink portion 45, before depositing the chamber structure 28 material.

The present inventions have been illustrated heretofore employing a cantilevered element configuration for the moving portion of a thermal actuator. Many other configurations of the moving portion of the thermal actuator may be conceived which will benefit from incorporation of the elements of the present inventions. Through actuator openings in the moving portion of the thermal actuator may be configured to reduce the mass of heated portions, to reduce the total area of the actuator that moves through the liquid, to provide liquid refill passages and to provide stationary positions adjacent moving elements for the location of strengthening and heat dissipation means.

Figure 19A:
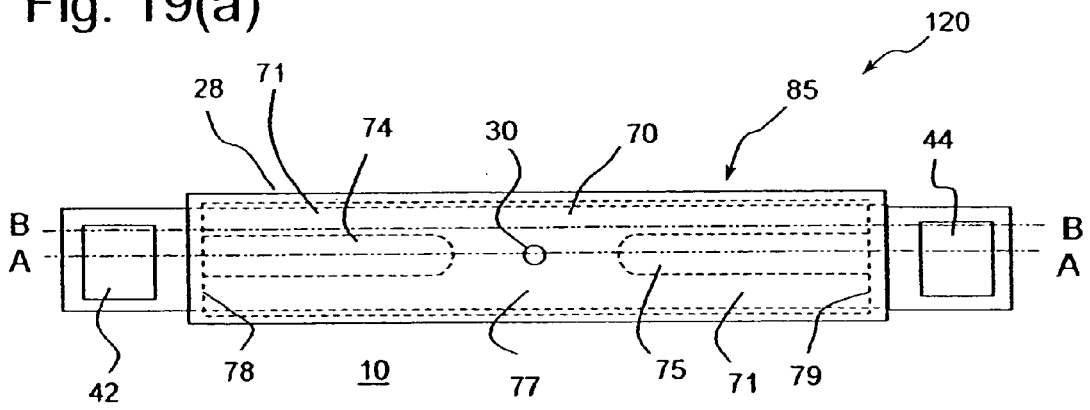
FIGS. 19(*a*) and 19(*b*) are enlarged plan views of an individual ink jet or liquid drop emitter unit according to an embodiment of the present invention.
Figure 19B:
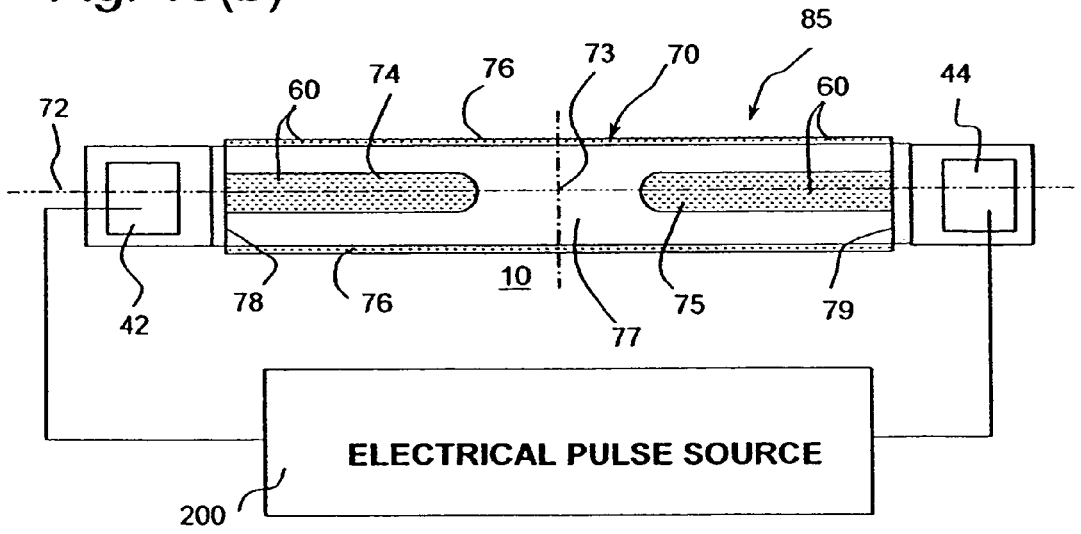

FIGS. 19(*a*)–22 illustrate one such alternative configuration of the present inventions wherein the moving element of the thermal actuator is an elongated beam anchored to two opposing anchor walls of the liquid chamber. The performance characteristics, fabrication process sequences and design alternatives discussed above with respect to cantilevered element thermal actuators are applicable in analogous fashion to a beam element thermal actuator and liquid drop emitter. Elements with like functions are indicated by the same element numbers used for the cantilevered element drop emitters illustrated in FIGS. 1–18(*c*).

FIGS. 19(*a*) and 19(*b*) illustrate, in enlarged plan view, a single drop emitter unit 120 having a beam element 70 as the moving portion of thermal actuator 85. Beam element 70 is indicated by phantom lines beneath an upper liquid chamber structure 28 in FIG. 19(*a*) and by solid lines in FIG. 19(*b*) wherein the upper liquid chamber structure 28 has been removed.

Beam element 70 extends from first anchor wall 78 to second anchor wall 79 of lower liquid chamber 12 which is formed in substrate 10. Beam element 70 is bonded to substrate 10. Beam element 70 has the shape of an elongated flat plate having a central liquid displacement portion 77 in close proximity to a nozzle 30. The area of central liquid displacement portion 77 is sized to cause sufficient fluid volume displacement adjacent nozzle 30 so that a liquid drop of the desired size is emitted. The lower fluid chamber 12 is formed slightly wider than cantilevered element 20 to provide clearance for the beam element movement.

First actuator opening 74 and second actuator opening 75 are located in the center of the moving portion of beam element 70 and away from the central liquid displacement portion 77. First and second actuator openings 74, 75 are symmetric about lengthwise axis 72 so as to counteract twisting tendencies about this axis. They are also positioned and shaped to be symmetric to each other about beam center axis 73. This symmetric arrangement promotes the deflection of beam element 70 in a direction normal to nozzle 70.

Although desirable from the perspective of overall deflection efficiency and drop emission in a direction normal to the nozzle face, the symmetric arrangement of actuator openings about beam center axis 73 is not necessary for the construction of a functioning beam element liquid drop emitter according to the present inventions. Configurations having one or more actuator openings on only one side of the center of a beam element are contemplated by the inventors as useful embodiments of the present inventions for some applications of liquid drop emitters.

First and second actuator openings 74, 75 contribute at least several functions to liquid drop emitter 120. Firstly, they narrow the portion of the moving element, beam element 70, that pushes and drags fluid during a drop emission event, saving energy. Secondly, they reduce the volume of beam element 70 that is heated, also saving energy. Thirdly, the width reduction of the moving element is accomplished while retaining a wide effective stance arising from the two-armed nature of the resulting beam shaft, counteracting any tendencies for twisting. And fourthly, first and second actuator openings 74, 75 provide a path for the refill of liquid from lower to upper liquid chambers without necessitating a wider drop emitter unit, thereby optimizing emitter packing density in an array of emitters.

FIG. 19(*b*) illustrates schematically the attachment of electrical pulse source 200 to a resistive heater (not shown) formed in a layer of beam element 70 at interconnect terminals 42, 44. Voltage differences are applied to voltage terminals 42 and 44 to cause resistance heating. In the plan views of FIGS. 19(*a*) and 19(*b*), the actuator central liquid displacement portion 77 moves toward the viewer when pulsed and drops are emitted toward the viewer from nozzle 30 in upper liquid chamber structure 28.

Figure 20A:
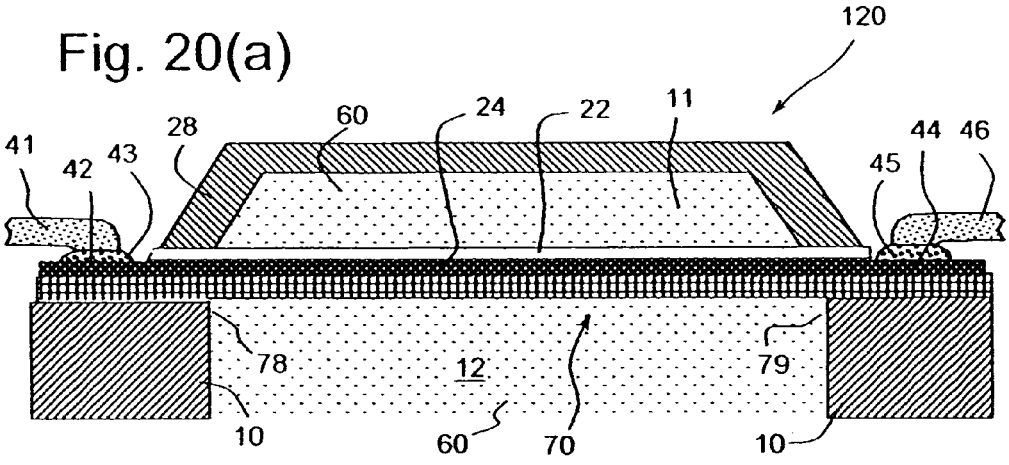
FIGS. 20(*a*)–20(*b*) are side views formed along the line B—B in FIG. 19(*a*) and FIG. 20(*c*) is a side view formed along line A—A in FIG. 19(*a*) of completed drop emitter units according to the present invention.
Figure 20B:
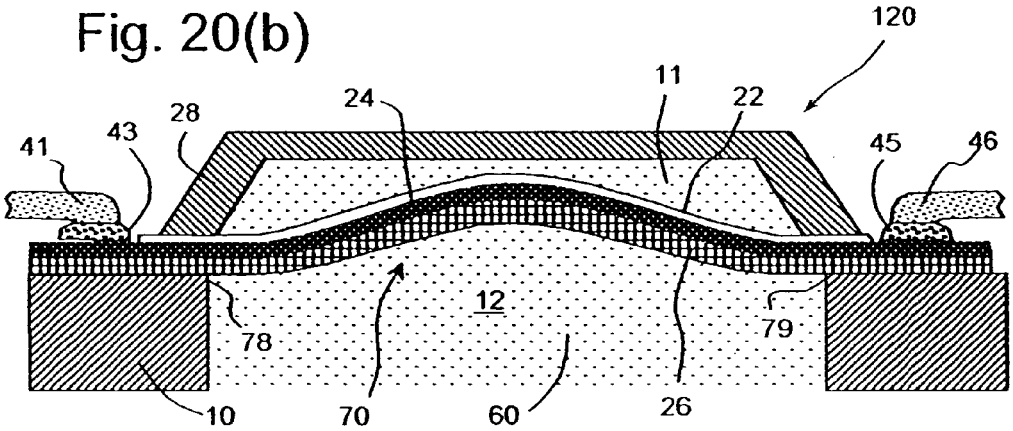
Figure 20C:
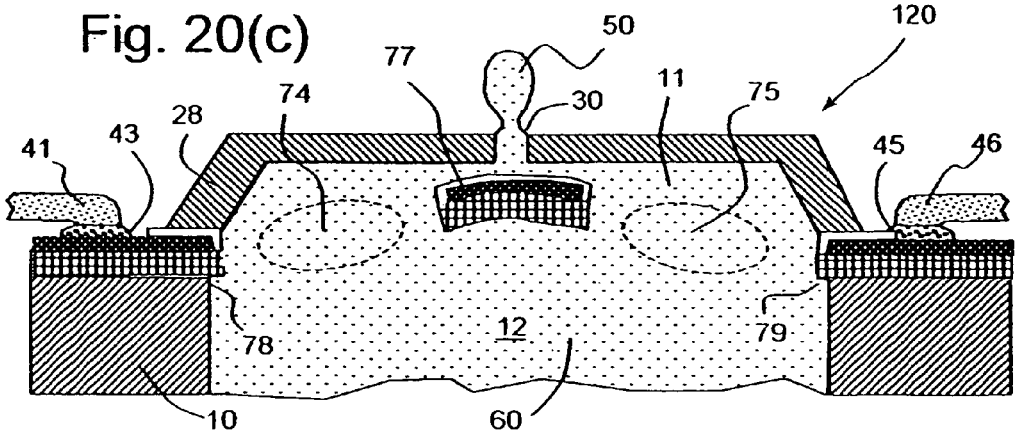

FIGS. 20(*a*)–20(*c*) illustrate in sectional side view a liquid drop emitter 120 according to a preferred embodiment of the present invention illustrated in FIGS. 19(*a*) and 19(*b*). FIGS. 20(*a*) and 20(*b*) illustrate a sectional view along line B—B in FIG. 19(*a*). FIG. 20(*c*) illustrates a sectional view along line A—A in FIG. 19(*a*). FIG. 20(*a*) shows the beam element 70 in a first position proximate to nozzle 30. FIGS. 20(*b*) and 20(*c*) illustrate the deflection of central liquid displacement portion 77 of the beam element 70 towards nozzle 30 to a second position. Rapid deflection of the beam element 70 to this second position pressurizes liquid 60 causing a drop 50 to be emitted. First and second actuator openings 74, 75 are indicated by oval shapes drawn in phantom lines in FIG. 20(*c*).

Beam element 70 is constructed of several layers in analogous fashion to the cantilevered elements discussed above. As illustrated in FIGS. 20(*a*)–20(*c*), deflector layer 24 causes upward deflection when it is thermally elongated with respect to other layers in the beam element 70. The bending response of beam element 70 must be rapid enough to sufficiently pressurize the liquid at the nozzle. Typically, electroresistive heating apparatus is adapted to apply heat pulses and an electrical pulse duration of less than 4 μsecs. is used and, preferably, a duration less than 2 μsecs.

Figure 21A:
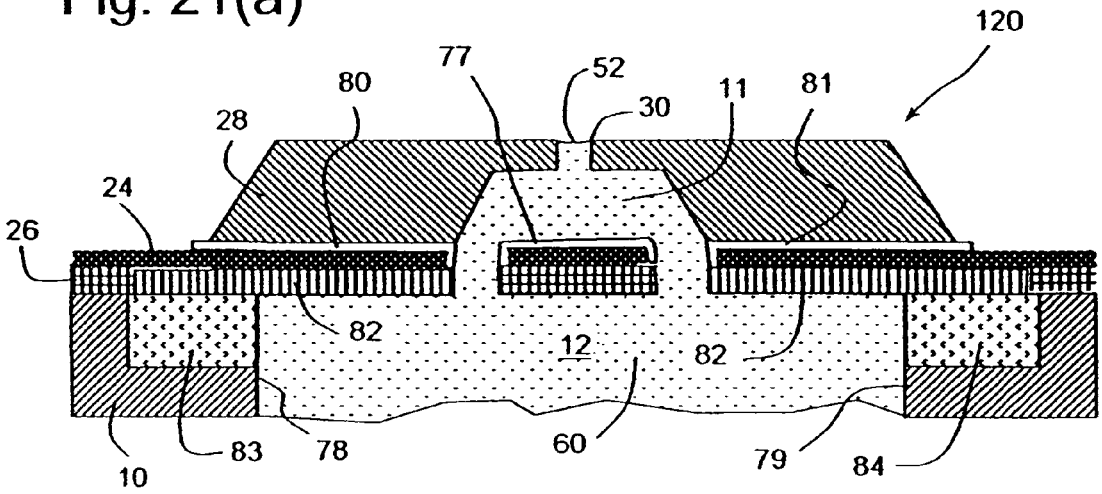
FIGS. 21(*a*)–21(*b*) are side views of completed drop emitter units of another embodiment of the present invention.
Figure 21B:
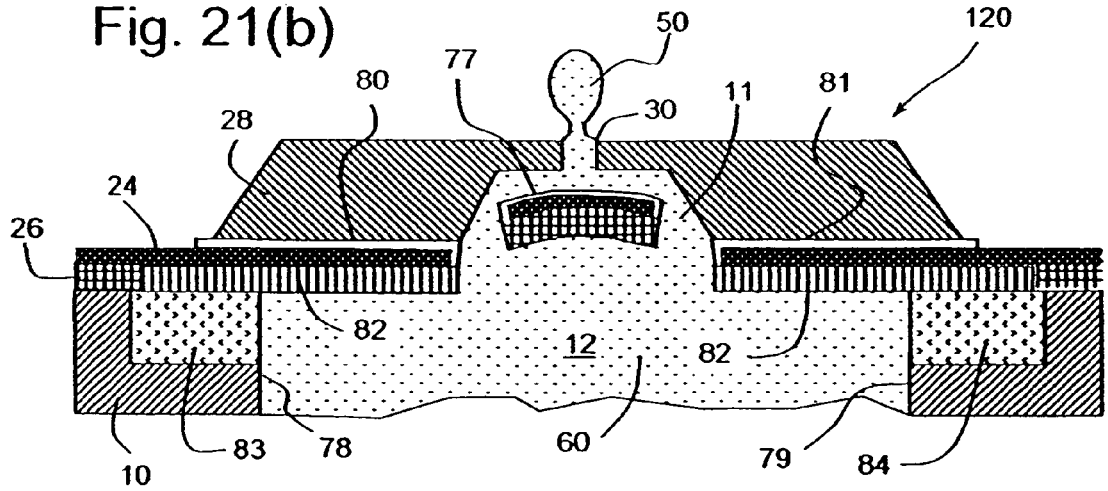

FIGS. 21(*a*) and 21(*b*) illustrate in sectional view an alternate embodiment of the present inventions employing a beam element thermal actuator. In this embodiment, first and second stationary portions are delineated by narrow first and second actuator openings in analogous fashion to the cantilevered configuration illustrated in FIGS. 17 and 18(*c*). Similarly, heat dissipation elements 82 are provided that make thermal contact with first and second heat sink portions 83,84 located in substrate 10 adjacent first and second anchor walls 78,79. Heat dissipation elements 82 provide a heat conduction pathway assist in dissipating heat from beam element 70. Beam element 70 is illustrated in a quiescent first position in FIG. 21(*a*) and in a deflected second position causing drop emission in FIG. 21(*b*).

Figure 22:
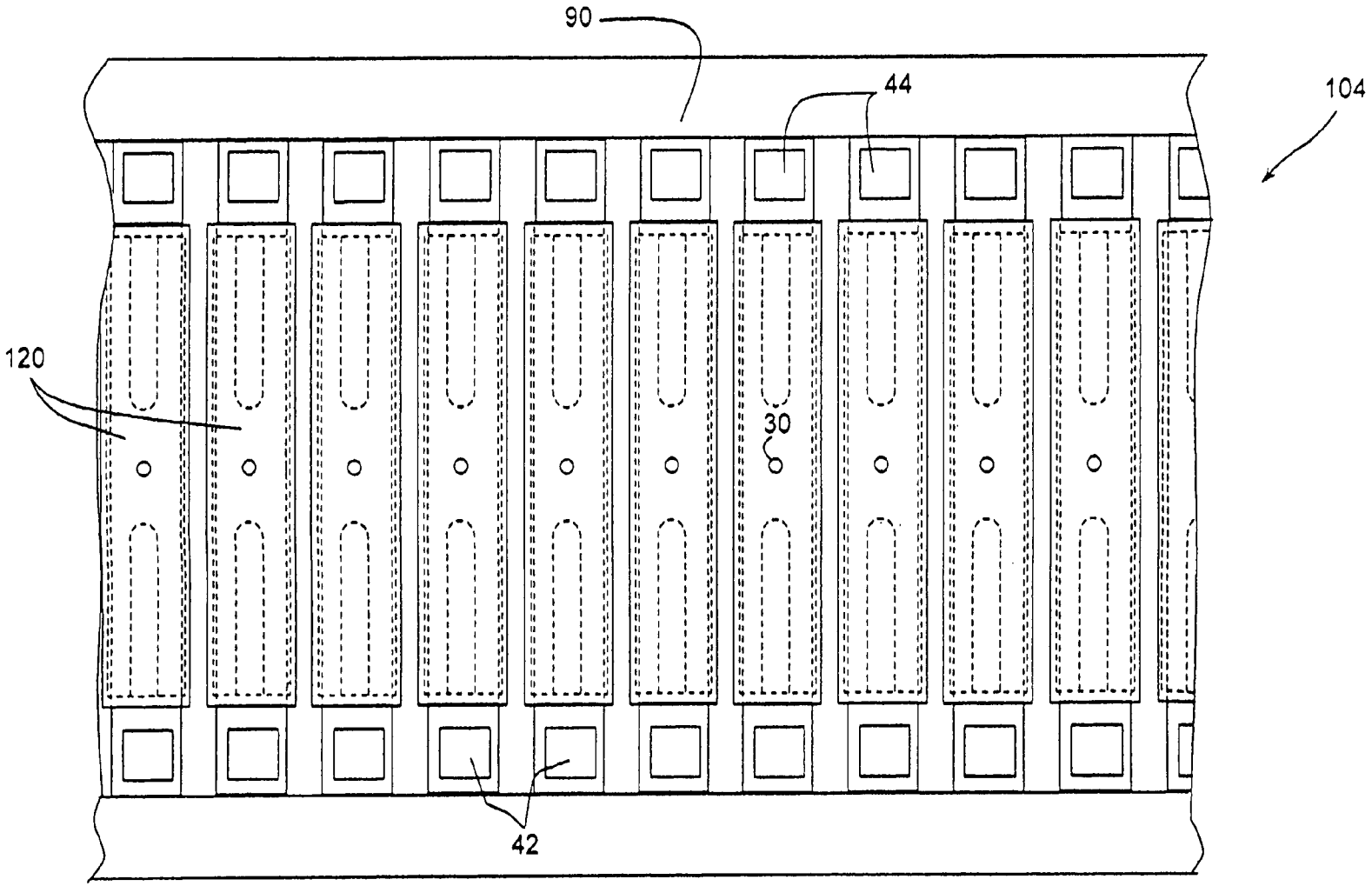
FIG. 22 is a plan view drop emitters in an array for the liquid drop emitters illustrated in FIGS. 19(*a*)–21(*b*).

FIG. 22 illustrates in plan view a portion of an array of drop emitters 120 forming an ink jet printhead 104. Printhead 104 is formed using drop emitter units as illustrated in FIGS. 19(*a*)–21(*b*) according to the present inventions. Element 90 of printhead 104 is a mounting structure which provides a mounting surface for microelectronic substrate 10 and other means for interconnecting the liquid supply, electrical signals, and mechanical interface features.

From the foregoing, it will be seen that this invention is one well adapted to obtain all of the ends and objects. The foregoing description of preferred embodiments of the invention has been presented for purposes of illustration and description. It is not intended to be exhaustive or to limit the invention to the precise form disclosed. Modification and variations are possible and will be recognized by one skilled in the art in light of the above teachings. Such additional embodiments fall within the spirit and scope of the appended claims.

The invention has been described in detail with particular reference to certain preferred embodiments thereof, but it will be understood that variations and modifications can be effected within the spirit and scope of the invention.

PARTS LIST

10 substrate
11 upper liquid chamber
12 lower liquid chamber
13 gap between moveable element and chamber wall
14 cantilevered element anchor location
15 thermal actuator with a cantilevered element 20
16 lower liquid chamber curved wall portion
17 anchored portion of cantilevered element 20
18 free edge area on substrate 10
19 wide free edge area around central stationary portion 35 of cantilevered element 20
20 cantilevered element with a slot in a central portion
21 moveable portion of cantilevered element 20
22 passivation layer
24 deflector layer
25 resistor portion of deflector layer 24
26 low expansion layer
27 free end portion of cantilevered element
28 upper liquid chamber structure, walls and top cover
29 sacrificial layer
30 nozzle
31 opening in lower passivation layer 22 for actuator opening 32

32 actuator opening in central portion of cantilevered element 20
33 refill opening in passivation layer 22
34 hot spot on cantilevered element 20 caused by current crowding
35 central stationary portion of cantilevered element 20
36 actuator opening formed as a narrow clearance gap delineating a central stationary portion of cantilevered element 20
37 liquid refill opening in central portion of cantilevered element 20
38 depression in upper chamber structure top surface
41 TAB lead
42 electrical input pad
43 solder bump
44 electrical input pad
45 heat sink portion
50 drop
52 liquid meniscus
60 working liquid
62 first resistor segment
64 second resistor segment
66 coupling segment
70 beam element with first and second actuator openings
71 bending portion
72 lengthwise axis
73 beam center
74 first actuator opening
75 second actuator opening
76 gap between beam element 70 and chamber walls
77 central liquid displacement portion
78 first anchor wall
79 second anchor wall
80 first stationary portion
81 second stationary portion
82 heat dissipation element
83 first heat sink portion
84 second heat sink portion
85 thermal actuator with a beam element 70
90 support structure
95 elongated shaft portion of cantilevered element 96
96 cantilevered element without an actuator opening
97 thermo-mechanical actuator having a cantilevered element 96 without an actuator opening
99 drop emitter unit having a thermo-mechanical actuator 97
100 ink jet printhead formed of drop emitter units using cantilevered element thermal actuators of the present inventions
102 ink jet printhead formed of drop emitter units not of the present inventions
104 ink jet printhead formed of drop emitter units using beam element thermal actuators of the present inventions
110 drop emitter unit having a cantilevered thermo-mechanical actuator 15
120 drop emitter unit having a beam thermo-mechanical actuator 85
200 electrical pulse source
300 controller
400 image data source
500 receiver

The invention claimed is:

1. A liquid drop emitter comprising:

(a) a chamber formed in a substrate and including a nozzle for emitting drops of a liquid;

(b) a thermo-mechanical actuator, extending into the chamber from at least one wall of the chamber, the thermo-mechanical actuator including a movable element comprising a plurality of layers, the movable element residing in a first position proximate to the nozzle;

(c) the movable element including a bending portion which bends when heated, the bending portion including at least one opening through the plurality of layers of the movable element to permit passage of the liquid through the at least one opening; and (d) apparatus adapted to apply heat pulses to the movable element resulting rapid deflection of the movable element to a second position, ejection of a liquid drop, and passage of liquid through the at least one opening.

2. The liquid drop emitter of claim 1 wherein the liquid drop emitter is a drop-on-demand ink jet printhead and the liquid is an ink for printing image data.

3. The liquid drop emitter claim 1 wherein one of the plurality of layers includes a deflector layer constructed of a deflector material having a high coefficient of thermal expansion and another of the plurality of layers includes a low expansion layer, attached to the deflector layer, constructed of a low expansion material having a low coefficient of thermal expansion.

4. The liquid drop emitter claim 3 wherein the deflector material is electrically resistive and the apparatus adapted to apply a heat pulse includes a resistive heater formed in the deflector layer.

5. The liquid drop emitter claim 4 wherein the deflector material is titanium aluminide.

6. The liquid drop emitter of claim 1 wherein the movable element is an elongated structure having a lengthwise axis and the at least one opening is substantially symmetric about the lengthwise axis.

7. The liquid drop emitter of claim 1 wherein the nozzle has a cross sectional area $A_n$ for passage of the liquid, the at least one opening having a total cross sectional area $A_m$ for passage of the liquid, wherein $A_n<A_m<10A_n$.

8. A liquid drop emitter comprising:

(a) a chamber formed in a substrate and including a nozzle for emitting drops of a liquid;

(b) a thermo-mechanical actuator including a cantilevered element extending from an anchor wall of the chamber and a free end residing in a first position proximate to the nozzle, the cantilevered element comprising a plurality of layers;

(c) the cantilevered element including a bending portion which bends when heated, the bending portion including at least one opening through the plurality of layers, located in a center of the bending portion, to permit passage of the liquid through the at least one opening; and (d) apparatus adapted to apply heat pulses to the thermo-mechanical actuator resulting rapid deflection of the free end to a second position, ejection of a liquid drop, and passage of liquid through the at least one opening.

9. The liquid drop emitter of claim 8 wherein the liquid drop emitter is a drop-on-demand ink jet printhead and the liquid is an ink for printing image data.

10. The liquid drop emitter claim 8 wherein one of the plurality of layers includes a deflector layer constructed of a deflector material having a high coefficient of thermal expansion and another of the plurality of layers includes a low expansion layer, attached to the deflector layer, constructed of a low expansion material having a low coefficient of thermal expansion.

11. The liquid drop emitter claim 10 wherein the deflector material is electrically resistive and the apparatus adapted to apply a heat pulse includes a resistive heater formed in the deflector layer.

12. The liquid drop emitter claim 11 wherein the deflector material is titanium aluminide.

13. The liquid drop emitter of claim 11 wherein the resistive heater is configured to have a first resistor segment and a second resistor segment each extending from the anchor wall and the at least one opening is located between the first and second resistor segments.

14. The liquid drop emitter of claim 13 wherein the at least one opening includes slot portions that define a central stationary portion of the cantilevered element that does not bend when the bending portion is heated.

15. The liquid drop emitter of claim 14 wherein the anchor wall of the chamber has an upper anchor wall portion and the upper anchor wall portion is extended along the central stationary portion of the cantilevered element.

16. The liquid drop emitter of claim 14 wherein the thermal conductivity of the deflector material is substantially greater than the thermal conductivity of the low expansion material and the low expansion material is removed in the central stationary portion of the cantilevered element.

17. The liquid drop emitter of claim 14 wherein the thermal conductivity of the low expansion material is substantially greater than the thermal conductivity of the deflector material and the deflector material is removed in the central stationary portion of the cantilevered element.

18. The liquid drop emitter of claim 14 wherein the substrate further includes a heat sink portion and a third material having high thermal conductivity is laminated to the central stationary portion and brought into good thermal contact with the heat sink portion.

19. The liquid drop emitter of claim 8 wherein the nozzle has a cross sectional area $A_n$ for passage of the liquid, the at least one opening having a total cross sectional area $A_m$ for passage of the liquid, wherein $A_n < A_m < 10A_n$.

* * * * *